US011348405B2

(12) United States Patent
Kershbaumer et al.

(10) Patent No.: US 11,348,405 B2
(45) Date of Patent: May 31, 2022

(54) SYSTEM, METHOD, AND APPARATUS FOR TRACKING MACHINE USE

(71) Applicants: James J. Kershbaumer, Langhorne, PA (US); James Peter Kershbaumer, Langhorne, PA (US)

(72) Inventors: James J. Kershbaumer, Langhorne, PA (US); James Peter Kershbaumer, Langhorne, PA (US)

(73) Assignee: Barzcash Inc., Levittown, PA (US)

( * ) Notice: Subject to any disclaimer, the term of this patent is extended or adjusted under 35 U.S.C. 154(b) by 85 days.

(21) Appl. No.: 17/101,125

(22) Filed: Nov. 23, 2020

(65) Prior Publication Data

US 2021/0074119 A1 Mar. 11, 2021

Related U.S. Application Data

(63) Continuation-in-part of application No. 16/662,708, filed on Oct. 24, 2019, now Pat. No. 10,960,291, which is a continuation-in-part of application No. 16/587,278, filed on Sep. 30, 2019, now Pat. No. 10,891,832.

(60) Provisional application No. 62/830,761, filed on Apr. 8, 2019.

(51) Int. Cl.

| | |
|---|---|
| ***A63D 15/00*** | (2006.01) |
| ***G07F 17/32*** | (2006.01) |
| ***G07F 17/38*** | (2006.01) |

(52) U.S. Cl.

CPC ..... *G07F 17/3234* (2013.01); *A63D 15/00* (2013.01); *G07F 17/38* (2013.01)

(58) Field of Classification Search

CPC ..... G07F 17/3234; G07F 17/38; A63D 15/00; A63B 2225/70; A63F 2250/14

USPC ..... 463/29

See application file for complete search history.

(56) References Cited

U.S. PATENT DOCUMENTS

| | | | | |
|---|---|---|---|---|
| 3,444,974 A * | 5/1969 | Green | G07F 17/38 194/240 |
| 8,016,687 B2 * | 9/2011 | Martin | G07F 17/38 473/24 |
| 2003/0155083 A1 | 8/2003 | MacDonald et al. | |

(Continued)

FOREIGN PATENT DOCUMENTS

WO 1999049429 A2 9/1999

OTHER PUBLICATIONS

International Search Report and Written Opinion for PCT Patent Application No. PCT/US21/60141, dated Apr. 1, 2022.

*Primary Examiner* — Allen Chan

(74) *Attorney, Agent, or Firm* — Ellenoff Grossman & Schole LLP; James M. Smedley; Alex Korona

(57) ABSTRACT

A tracking apparatus for a machine having an operation assembly is disclosed. The tracking apparatus has an electric relay configured to be connected to the operation assembly, a tracking device that is connected to the electric relay, and a display assembly that is selectively connected to the electric relay. The display assembly is configured to transfer an electrical pulse from the display assembly to the tracking device via the electric relay. The operation assembly performs an operation when the electrical pulse is transferred to the tracking device. The operation includes activating one or more actuators to move the operation assembly that is a structural member.

20 Claims, 20 Drawing Sheets

(56) References Cited

U.S. PATENT DOCUMENTS

| | | | | |
|---|---|---|---|---|
| 2005/0215317 | A1* | 9/2005 | Gramstrup | G07F 17/3223 463/29 |
| 2006/0121982 | A1* | 6/2006 | Martin | G07F 17/38 463/25 |
| 2009/0170602 | A1* | 7/2009 | Martin | G07F 17/3227 463/39 |
| 2013/0190078 | A1* | 7/2013 | Goto | G07F 17/3258 463/25 |
| 2020/0316453 | A1 | 10/2020 | Kershbaumer et al. | |

* cited by examiner

| SW1 | TIME 1 (A) | TIME 2 (B) | FUNCTION |
|---|---|---|---|
| | OFF | OFF | STRAIGHT VEND |
| | OFF | ON | 5 MIN* |
| | ON | OFF | 10 MIN* |
| | ON | ON | 15 MIN* |

| COIN COUNT (C) | COIN PULSE (D) |
|---|---|
| OFF | OFF |
| ON | ON |

*ADDITIONAL TIME WITH JP2

20 MIN
30 MIN
45 MIN
60 MIN

FIG. 11

| SW2 | COIN 1 (A) | COIN 2 (B) | COIN 3 (C) | COIN 4 (D) | COST |
|---|---|---|---|---|---|
| | OFF | OFF | OFF | OFF | 0.25 |
| | OFF | OFF | ON | OFF | 0.50 |
| | OFF | ON | OFF | OFF | 0.75 |
| | OFF | ON | ON | OFF | 1.00 |
| | ON | OFF | OFF | OFF | 1.25 |
| | ON | OFF | ON | OFF | 1.50 |
| | ON | ON | OFF | OFF | 1.75 |
| | ON | ON | ON | OFF | 2.00 |
| | OFF | OFF | OFF | ON | 2.50 |
| | OFF | OFF | ON | ON | 3.00 |
| | OFF | ON | OFF | ON | 3.50 |
| | OFF | ON | ON | ON | 4.00 |
| | ON | OFF | OFF | ON | 4.50 |
| | ON | OFF | ON | ON | 5.00 |
| | ON | ON | OFF | ON | 5.50 |
| | ON | ON | ON | ON | 6.00 |

FIG. 12

| SW1 | TIME 1 (1) | TIME 2 (2) | JP2 | FUNCTION |
|---|---|---|---|---|
| | ON | ON | S | 3 MIN* |
| | ON | OFF | S | 5 MIN* |
| | OFF | ON | S | 10 MIN* |
| | OFF | OFF | S | 15 MIN* |
| | ON | ON | D | 20 MIN |
| | ON | OFF | D | 30 MIN |
| | OFF | ON | D | 45 MIN |
| | OFF | OFF | D | STRAIGHT |

FIG. 22A

| COIN COUNT (3) | COIN PULSE (4) |
|---|---|
| OFF | OFF |
| ON | ON |

FIG. 22B

| SW2 | COIN 1 (1) | COIN 2 (2) | COIN 3 (3) | COIN 4 (4) | COST |
|---|---|---|---|---|---|
| | OFF | OFF | OFF | OFF | 0.25 |
| | OFF | OFF | ON | OFF | 0.50 |
| | OFF | ON | OFF | OFF | 0.75 |
| | OFF | ON | ON | OFF | 1.00 |
| | ON | OFF | OFF | OFF | 1.25 |
| | ON | OFF | ON | OFF | 1.50 |
| | ON | ON | OFF | OFF | 1.75 |
| | ON | ON | ON | OFF | 2.00 |
| | OFF | OFF | OFF | ON | 2.50 |
| | OFF | OFF | ON | ON | 3.00 |
| | OFF | ON | OFF | ON | 3.50 |
| | OFF | ON | ON | ON | 4.00 |
| | ON | OFF | OFF | ON | 4.50 |
| | ON | OFF | ON | ON | 5.00 |
| | ON | ON | OFF | ON | 5.50 |
| | ON | ON | ON | ON | 6.00 |

FIG. 22C

SYSTEM, METHOD, AND APPARATUS FOR TRACKING MACHINE USE

CROSS-REFERENCE TO RELATED APPLICATIONS

This application claims the benefit of U.S. Nonprovisional patent application Ser. No. 16/662,708 filed on Oct. 24, 2019, which claims priority to U.S. Nonprovisional patent application Ser. No. 16/587,278 filed on Sep. 30, 2019, which claims priority to provisional application 62/830,761 filed Apr. 8, 2019, the entire disclosure of each of which is incorporated herein by reference.

TECHNICAL FIELD

The present disclosure is directed to a system, method, and apparatus for tracking, and more particularly, to a system, method, and apparatus for tracking machine use.

BACKGROUND OF THE DISCLOSURE

Conventional pool tables such as Diamond pool tables typically include a switch for free play (e.g., payment features are disabled such as during league play) that operates based on initiation via a key. When a pool table switches to free play mode, though, there is no efficient way to track how many games have been played or if the key has been operated to turn off free play at an appropriate time (e.g., when free play is designated to end such as after a pool league time period for pay is over). Also, there is no efficient way to audit the time and/or cash or other payment that goes into the pool table (e.g., whether the play was pay play or free play).

Some conventional pool tables such as Valley, Dynamo, Great American, and other pool table manufactures include side doors where a complete set of pool balls is visible in the table to a user before that user puts his or her money into the table (e.g., to vend) and to drop the pool balls to start a pool game. During periods of designated free play (e.g., when a pool league night occurs), an operator (e.g., a bar owner) typically uses 2 keys to take the side door off each table designated for free play so that pool league players play for free (e.g., or at least do not provide payment to the table). If the door that is removed is not replaced again and locked, then anyone can play for free on the table (until the door is placed back on and locked in place). Accordingly, an amount of free play typically occurs before and after designated free play times such as designated league play times, as the door is typically removed some time before free play is to begin and is typically replaced some time after free play ends. As a result, vendors lose payments that might have been received based on the extended free play times involved with removing and replacing the doors.

Conventional pool tables and techniques also involve additional costs incurred based on typical free play (e.g., league play) operation. Operators may have to cover pool tables (e.g., repair or replace covers) and maintain (e.g., repair and replace) rubber cushions of conventional tables based on excessive game play and use of tables that occurs during free play such as league play. For example, additional repair, maintenance, and part replacement is caused based on significant amounts of table use that occurs during free play such as league play. Although operators such as bar owners may make up the increased cost of repair and maintenance by selling food and drinks to league customers, the additional costs reduce profits made by operators.

Some conventional pool tables such as tables manufactured by Valley and Dynamo attempt to control free play such as by pool leagues. These tables included a motor with a small electronic board and a bill verifier. This type of table is programmed to open the window described above for free play such as during pool league play. However, because pool league times constantly change and players often demand practice time, the windows are typically not opened at desired times. As a result, free play may not occur at or may exceed the designated times using the conventional tables. Also, once the pool table opens for free play, there is still no efficient way to track how many games are played using conventional pool tables and techniques. Also, the bill verifier installed on the conventional table uses a significant amount of battery power and typically runs out of power before it can be recharged. When the battery lacks sufficient power or charge, the window described above may open or fall off of free play and not provide free play as programmed. Alternatively, to keep the battery charged, a power cord is typically run across a floor, which presents an undesirable obstruction or tripping hazard to players.

Accordingly, conventional pool tables and techniques do not efficiently and effectively track pool league play and do not control a period of time of free play (when and how long). Also, conventional pool tables and techniques do not control how many games of pool are actually played during free play such as league play.

Also in the area of automated teller machines (ATMs), machines have flaws that create variabilities for employee theft and removal of ATMs from locations (e.g., employee unauthorized vault access). Locations at which ATMs are installed also pose a risk of theft when a loss of power or electricity occurs at the location. For example, when an ATM company sends an employee to fill an ATM, conventional systems do not provide a way to track (e.g., exactly track) when that employee arrived or left the location.

The exemplary disclosed system, method, and apparatus of the present disclosure is directed to overcoming one or more of the shortcomings set forth above and/or other deficiencies in existing technology.

SUMMARY OF THE DISCLOSURE

In one exemplary aspect, the present disclosure is directed to a tracking apparatus for a machine having an operation assembly. The tracking apparatus includes an electric relay configured to be connected to the operation assembly, a tracking device that is connected to the electric relay, and a display assembly that is selectively connected to the electric relay. The display assembly is configured to transfer an electrical pulse from the display assembly to the tracking device via the electric relay. The operation assembly performs an operation when the electrical pulse is transferred to the tracking device. The operation includes activating one or more actuators to move the operation assembly that is a structural member.

In another exemplary aspect, the present disclosure is directed to a method. The method includes providing an operation assembly of a game machine, connecting an electric relay to the operation assembly, connecting a tracking device to the electric relay, and selectively connecting a display assembly to the electric relay. The method also includes transferring an electrical pulse from the display assembly to the tracking device via the electric relay, actuating the operation assembly that is a structural member by actuating one or more solenoids when the electrical pulse is received by the tracking device, and counting the electrical pulse with the tracking device.

In another exemplary aspect, the present disclosure is directed to a tracking apparatus for a machine having an operation assembly. The tracking apparatus includes an electric relay configured to be connected to the operation assembly, a tracking device that is connected to the electric relay, and a display assembly that is selectively connected to the electric relay. The display assembly is configured to transfer an electrical pulse from the display assembly to the tracking device via the electric relay. The operation assembly performs an operation when the electrical pulse is transferred to the tracking device. The tracking device counts the electrical pulse.

In another exemplary aspect, the present disclosure is directed to a method. The method includes providing an operation assembly of a game machine, connecting an electric relay to the operation assembly, connecting a tracking device to the electric relay, selectively connecting a display assembly to the electric relay, transferring an electrical pulse from the display assembly to the tracking device via the electric relay, actuating the operation assembly when the electrical pulse is received by the tracking device, counting the electrical pulse with the tracking device, and activating an indicator of the display assembly when the electrical pulse is received by the tracking device.

In another exemplary aspect, the present disclosure is directed to a tracking apparatus for a machine having an operation assembly. The tracking apparatus includes an electric relay configured to be connected to the operation assembly, a tracking device that is connected to the electric relay, and an electronic payment device that is connected to the electric relay. The electric relay is configured to transfer a first electrical pulse from the operation assembly to the tracking device. The electric relay is configured to transfer a second electrical pulse from either the electronic payment device or the operation assembly to the tracking device. The relay transfers the first electrical pulse or the second electrical pulse when the operation assembly performs an operation.

In another exemplary aspect, the present disclosure is directed to a method. The method includes providing an operation assembly of a game machine, connecting an electric relay to the operation assembly, connecting a tracking device to the electric relay, and connecting an electronic payment device to the electric relay. The method also includes transferring a first electrical pulse from the operation assembly to the tracking device via the electric relay, transferring a second electrical pulse from either the electronic payment device or the operation assembly to the tracking device via the electric relay, and transferring the first electrical pulse or the second electrical pulse when the operation assembly releases at least one playing object of the game machine.

BRIEF DESCRIPTION OF THE DRAWINGS

Accompanying this written specification is a collection of drawings of exemplary embodiments of the present disclosure. One of ordinary skill in the art would appreciate that these are merely exemplary embodiments, and additional and alternative embodiments may exist and still within the spirit of the disclosure as described herein.

FIG. 11 is a chart illustration of an exemplary embodiment of the present disclosure;

FIG. 12 is a chart illustration of an exemplary embodiment of the present disclosure;

FIG. 22A is a chart illustration of an exemplary embodiment of the present disclosure;

FIG. 22B is a chart illustration of an exemplary embodiment of the present disclosure;

FIG. 22C is a chart illustration of an exemplary embodiment of the present disclosure;

DETAILED DESCRIPTION AND INDUSTRIAL APPLICABILITY

The exemplary disclosed system, method, and apparatus may include a component and/or application (e.g., app such as a Pay Range app) that may be operably connected (e.g., hooked up) to any pay pool table such as a coin-operated pool table (e.g., coin-operated Diamond pool table or other suitable mechanical pool table). In at least some exemplary embodiments, the component and/or application may be any suitable payment network component and/or application for coin-operated machines. For example, the exemplary component and/or application may be a Pay Range Blue Key Plus component and relay board. Also for example, the exemplary disclosed system, method, and apparatus may include a universal board (e.g., a BarZcash Universal Board) for connecting any suitable component (e.g., a beacon, a debit/credit card readers, or a Near Field Communication receivers) to any suitable machine.

Figure 1:
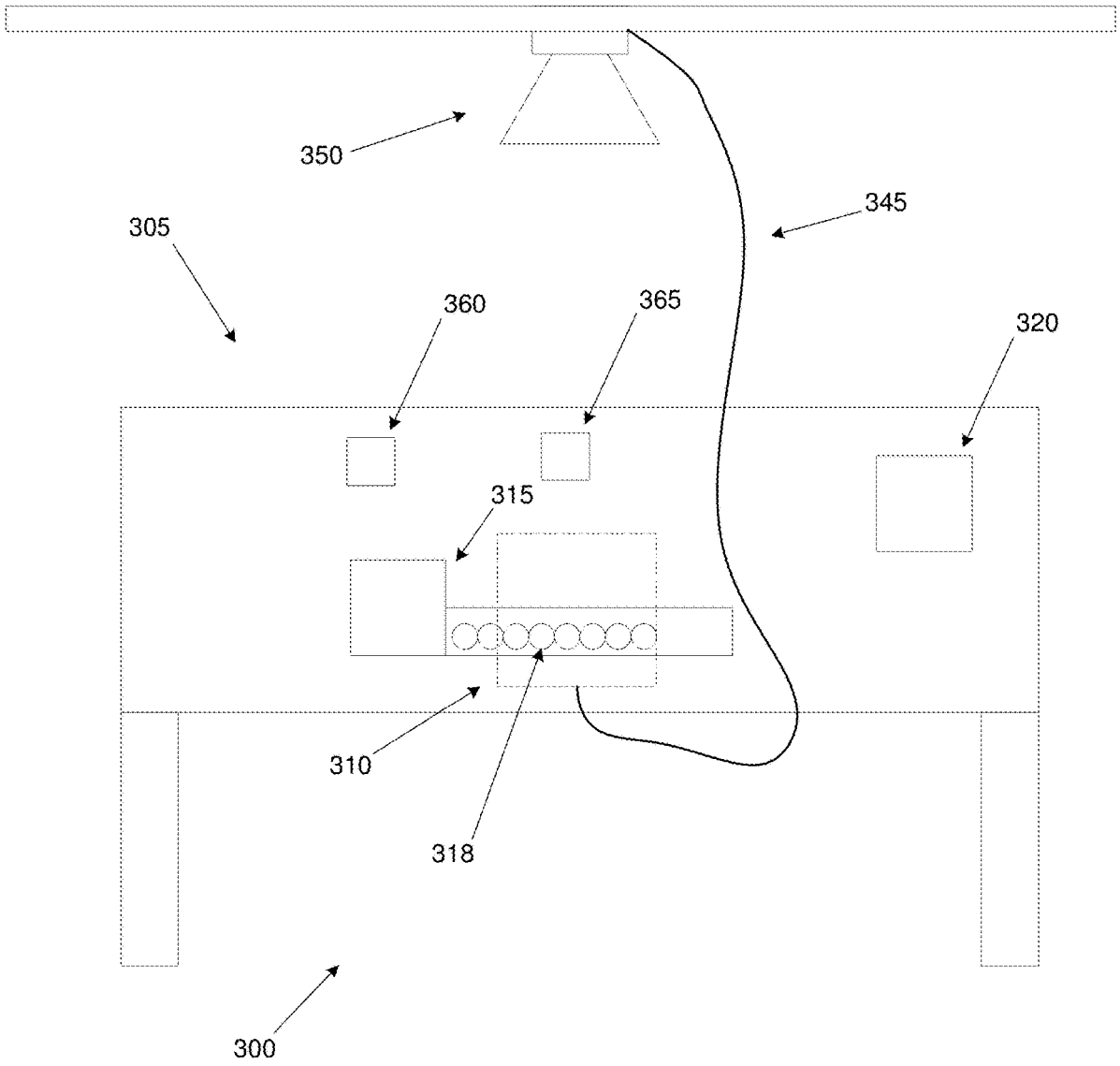
FIG. 1 is a schematic illustration of an exemplary embodiment of the present disclosure.

In at least some exemplary embodiments and as illustrated in FIG. 1, an exemplary system 300 may include a machine 305 and a tracking system 310. Tracking system 310 may track a use (e.g., machine use) of machine 305. For example, tracking system 310 may track a number of times and/or a length of time machine 305 is used, an amount of money paid to machine 305 (e.g., by coin, currency, or electronic payment as described for example herein), an amount of material or goods dispensed by machine 305, and/or any other suitable measure of an operation of machine 305. Tracking system 310 may be disposed within and/or on machine 305. In at least some exemplary embodiments, tracking system 310 may be disposed partially or substantially entirely within machine 305.

In at least some exemplary embodiments, the exemplary disclosed machine (e.g., machine 305) may be a coin-operated and/or bill-operated device such as a pool or billiards table, an arcade or game center device (e.g., air hockey or any other desired machine), a machine for shaping and stamping coins (e.g., souvenir penny), a laundry machine, gambling machine such as a slot machine, and/or any other desired machine that may operate based on inserting coins, bills, or other forms of payment (e.g., electronic payment). The exemplary disclosed machine may also be a machine used for efficient parking at stadiums, arenas, parking garages, designated municipal parking, and/or other suitable locations for parking vehicles. For example, a parking gate may be raised once the exemplary disclosed system or machine receives data that a fee was paid to park. The exemplary disclosed machine may also be an automated teller machine (ATM).

Machine 305 may include an operation assembly 315. Operation assembly 315 may be any suitable assembly that performs an operation of machine 305 such as, for example, an assembly that drops or provides a play ball or balls, dispenses a material, good, or product, provides an interaction with a user, allows a user to utilize or play machine 305, and/or any other suitable operation. Operation assembly 315 may release one or more objects 318 (e.g., from a cavity of machine 305). Object 318 may be any suitable object such as a ball (e.g., a pool ball) or any other suitable playing object, a product (e.g., such as a vending machine snack, candy, or an electronic device), material, fluid such as a brewed beverage, currency or money, or any other desired object. For example, operation assembly 315 may be a switch of a pool table that releases or drops objects 318 that may be pool balls from a cavity of machine 305 for playing a game of pool or billiards when machine 305 may be a pool table. Operation assembly 315 may be configured to receive cash (e.g., coins and/or currency such as bills). For example, operation assembly 315 may include a mechanical coin slot and/or bill receiver assembly that may be actuatable by a user. For example, a user may insert coins into operation assembly 315 and push a component in or out to insert the coins into machine 305, which may cause operation assembly 315 to operate (e.g., drop pool balls, provide a material, product, or good, allow a user to operate machine 305, and/or any other suitable operation). In at least some exemplary embodiments, operation assembly 315 may be a mechanical push slot into which a user may insert money to cause machine 305 that may be a pool (table) machine to drop pool balls for use by players.

Figure 2:
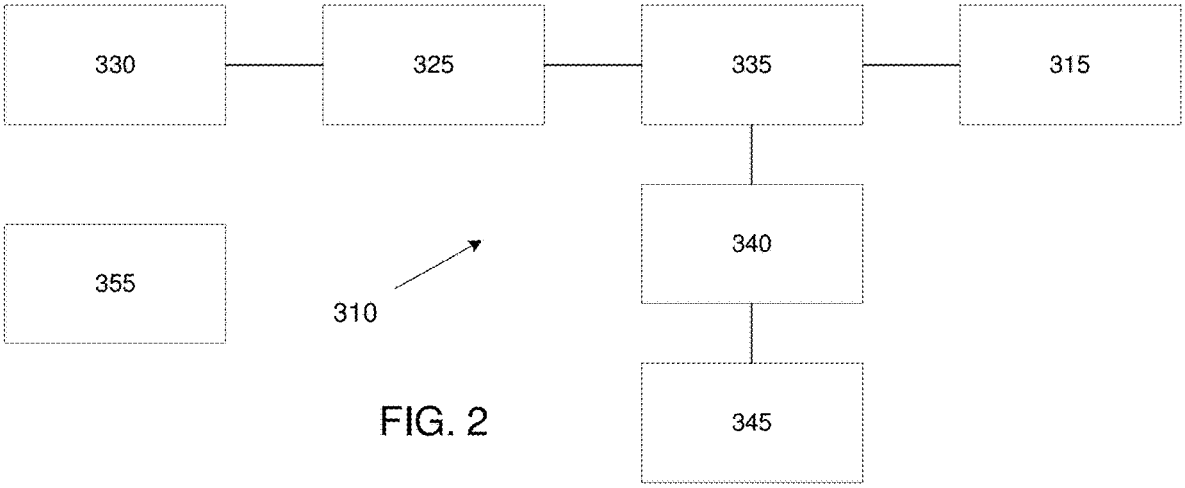
FIG. 2 is a schematic illustration of an exemplary embodiment of the present disclosure.
Figure 3:
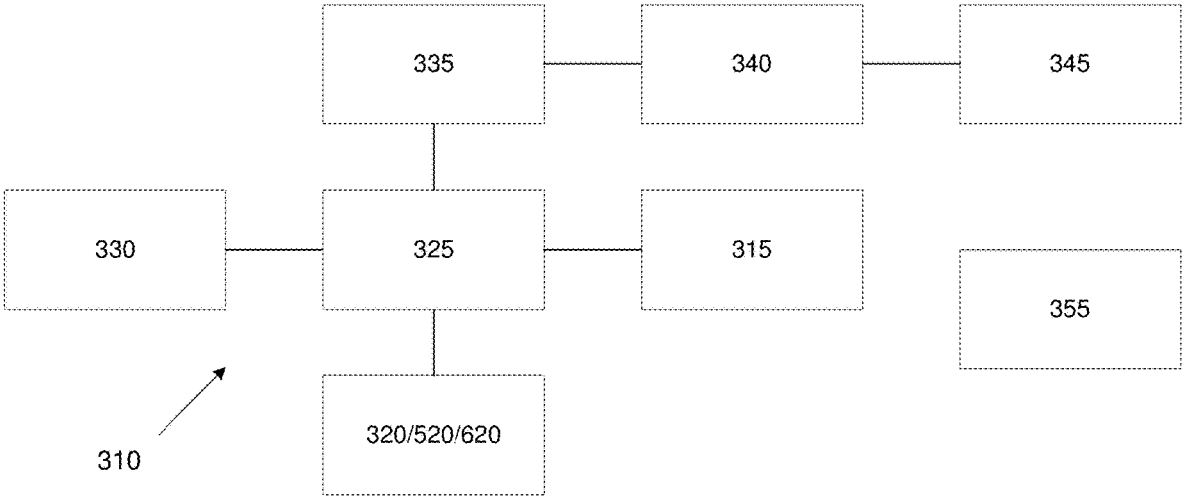
FIG. 3 is a schematic illustration of an exemplary embodiment of the present disclosure.

As illustrated in FIGS. 1-3, tracking system 310 may include a display assembly 320, a relay 325, a payment device 330, a tracking device 335, and a power storage 340. Display assembly 320, relay 325, payment device 330, and tracking device 335 may be electrically connected and/or communicate data between each other, and may be powered by power storage 340. Components of tracking system 310 may also be electrically connected and/or communicate data with components of machine 305 such as, for example, operation assembly 315. In at least some exemplary embodiments, some or all components of tracking system 310 may comprise a board (e.g., a universal board).

Relay 325 may be any suitable relay or switching device that may be selectively controlled to control an operation of tracking system 310. Relay 325 may be an electric relay. Relay 325 may be any suitable electric switching device. For example, relay 325 may be an electromagnetic relay. Relay 325 may be a solid state relay, an electromechanical relay, a hybrid relay, a reed relay, or a thermal relay. In at least some exemplary embodiments, relay 325 may be a relay assembly having any desired number of poles and throws. For example, relay 325 may include e.g., one or more single pole single throw (SPST) relays, single pole double throw (SPDT) relays, double pole single throw (DPST) relays, and/or double pole double throw (DPDT) relays. For example, relay 325 may be a double pole double throw (DPDT) relay. Relay 325 may be a relay of any desired voltage such as 5 volt, 12 volt, 24 volt, or any other desired voltage (e.g., between 9 volts DC and 24 volts DC). In at least some exemplary embodiments, relay 325 may be a DPDT 12 volt relay. Relay 325 may be a 5 volts to 24 volts DC switchable connector (e.g., that may close any suitable type of voltage to initiate an operation of machine 305). For example, relay 325 may be a universal board having coin switch inputs for machine 305 (e.g., that may be a coin switch crediting device such as a video game, pool table, or any other suitable game machine). In at least some exemplary embodiments, some or all components of tracking system 310 may comprise a board (e.g., a universal board) that may include inputs to start or credit machine 305 having an output that may close a relay. In at least some exemplary embodiments, machine 305 may have an output connection that may be connected with payment device 330 (e.g., that has a plurality of inputs such as three coin sensing inputs for a bill validator and/or coins).

Payment device 330 may be any suitable device for accepting and processing wireless payments such as, for example, payments made via a smart device (e.g., smartphone). Payment device 330 may be an electronic payment device. Payment device 330 may run software for processing electronic payments via wireless networks for facilitating payment to automated machines (e.g., machine 305). For example, payment device 330 may include a transceiver for wirelessly communicating (e.g., via Bluetooth, Wi-Fi, cellular, Near Field communication, and/or any other suitable method) with mobile devices such as smartphones or smart tablets to make payments. Payment device 330 may be electrically connected to (e.g., installed in) machine 305 to allow users to make credit card payments to utilize machine 305. Payment device 330 may include a relay board and any other suitable components for facilitating wireless payments. For example, a user may use a smartphone to make a payment (e.g., credit card or other e-banking payment) wirelessly using a smartphone or other device to machine 305 via payment device 330. In at least some exemplary embodiments, payment device 330 may be a PayRange device (e.g., a PayRange Blue Key Pulse) or similar device. Components of system 300 may be operated by a user utilizing a Pay Range application (e.g., app) running on a smart device such as a smartphone or other suitable device. Payment device 330 may be a Beacon app, a debit/credit card reader, an NFC (Near field Communication) receiver, a Pay Range device (e.g., Pay Range Blue Key device), an advanced metering infrastructure device, an automatic meter reading device, or any other suitable device that may be connected to components of tracking system 310.

Tracking device 335 may be any suitable device for counting or measuring an operation of operation assembly 315, payment device 330, and/or any other desired component of system 300. Tracking device 335 may be a pool table tracking device, an automated teller machine (ATM) tracking device, or a tracking device for any other desired type of machine. Tracking device 335 may be a mechanical and/or electromechanical counter. For example, tracking device 335 may be any suitable DC (direct current) coin counter. In at least some exemplary embodiments, tracking device 335 may be a 12 volt DC coin counter or a counter of any other desired voltage (e.g., a 5 volt DC counter). Tracking device 335 may receive and/or emit electrical pulses to or from other suitable components of tracking system 310 and/or machine 305. For example, tracking device 335 may receive and/or emit DC electrical pulses (e.g., 5 volt, 12 volt, 24 volt, or any other desired voltage). Tracking device 335 may count or measure an operation of operation assembly 315, payment device 330, and/or any other desired component of system 300 based on receiving and/or emitting pulses, and thereby track or measure an operation of one or more machines 305. For example, tracking device 335 may track and measure league play and/or cash play of machines 305 that are pool tables (e.g., or any other use of machine 305 that is any suitable type of machine). Tracking device 335 may include a storage medium for storing data of measurements or counts of an operation of components of system 300 such as described herein (e.g., or may transfer data to another component of system 300 such as the exemplary disclosed controller described below or any other suitable component of system 300).

Power storage 340 may be any suitable device or assembly for storing power or energy such as a battery. For example, power storage 340 may be any suitable type of battery for powering components of tracking system 310. For example, power storage 340 may include a primary cell battery and/or a secondary cell battery. For example, power storage 340 may include a lithium battery, an alkaline battery, a nickel-cadmium battery, a zinc-carbon battery, and/or any other suitable type of battery. In at least some exemplary embodiments, power storage 340 may be a deep cell battery. In at least some exemplary embodiments, power storage 340 may be a 12 volt DC battery.

In at least some exemplary embodiments and as illustrated in FIG. 1, power storage 340 may be selectively connected to a power source 350 via a power connector 345. For example, power storage 340 may be connected to power source 350 that may be an electrical outlet (e.g., or any other suitable power source such as an engine, motor, or generator) via power connector 345 that may be an electrical wire or cable (e.g., electrical cord). In at least some exemplary embodiments, power connector 345 may be a 12 volt (e.g., or any other desired voltage) DC cable that may be disposed at a bottom of machine 305 and may be electrically connected to power storage 340 disposed in or on machine 305. Power source 350 may be a 12 volt (e.g., or any other desired voltage) DC trickle charger that may be disposed on top of a light (e.g., a pool table lamp) where for example 110 volts (e.g., or 220 volts) may already be provided for an operation of the light. Power connector 345 that may be a charging cord may be dropped down from power source 350 that may be integrated with the lamp and plugged into power storage 340 (e.g., or another component of machine 305). In at least some exemplary disclosed embodiments, this exemplary configuration may keep substantially all tripping hazards associated with system 300 off of a floor (e.g., so that custodial staff such as cleaning personnel at the end of a night after use of machine 305, e.g., game play, may avoid tripping over obstructions such as power connector 345).

FIGS. 2 and 3 illustrate exemplary embodiments of how the exemplary disclosed components of tracking system 310 may be configured and electrically connected to each other. Exemplary disclosed electrical pulses may be emitted and/or received by adjacent exemplary components and/or via other components as described for example herein. Relay 325 may electrically connect operation assembly 315, payment device 330, and/or tracking device 335. Tracking device 335 may emit and/or receive electrical pulses and/or communicate with operation assembly 315 and/or payment device 330 (e.g., and/or display assembly 320) via relay 325. Tracking device 335 may thereby count, track, and/or measure an operation of any desired component of system 300 (e.g., operation assembly 315 and payment device 330).

Display assembly 320 may be any suitable assembly or device for displaying information to users of system 300 (e.g., game players when machine 305 is a game, users when machine 305 dispenses goods, material, or currency, or any other suitable user). For example, display assembly 320 may be a light-emitting diode (LED) or liquid crystal display (LCD). Display assembly 320 may include a plurality of LED and/or LCD lighting elements that may display information to users. In at least some exemplary embodiments, display assembly 320 may include a plurality of LED lights (e.g., any desired number such as 8, 10, 12, or other desired number).

Tracking system 310 may include electronic control systems and/or control boards. For example as illustrated in FIGS. 2 and 3, tracking system 310 may include a controller 355. Controller 355 may include for example a processor (e.g., micro-processing logic control device) or board components. Controller 355 may include input/output arrangements that allow it to be connected (e.g., via wireless and/or electrical connection such as wires or electrical lines) to other components of system 300. For example, controller 355 may control an operation of system 300 (e.g., including machine 305 and/or tracking system 310) based on user input received from one or more user interfaces (e.g., interfaces of machine 305), computer modules (e.g., in wireless and/or direct connection to machine 305 and/or tracking system 310), and/or user devices (e.g., such as smartphones have applications for operating system 300). Controller 355 may be a separate controller or may be integrated into one or more components of tracking system 310 (e.g., tracking device 335).

In at least some exemplary embodiments, some or all components of tracking system 310 may be isolated from a power source and/or wiring of machine 305 to protect against potential damage that may be caused to electronics in machine 305. For example, relay 325 may isolate voltage powering components of tracking system 310 from voltage of machine 305 to substantially prevent a short circuit or other unsuitable operation of machine 305.

In at least some exemplary embodiments, the exemplary disclosed system may include a tracking apparatus for a machine having an operation assembly. The tracking apparatus may include an electric relay (e.g., relay 325) configured to be connected to the operation assembly (e.g., operation assembly 315), a tracking device (e.g., tracking device 335) that may be connected to the electric relay, and an electronic payment device (e.g., payment device 330) that may be connected to the electric relay. The electric relay may be configured to transfer a first electrical pulse from the operation assembly to the tracking device. The electric relay may be configured to transfer a second electrical pulse from either the electronic payment device or the operation assembly to the tracking device. The relay may transfer the first electrical pulse or the second electrical pulse when the operation assembly performs an operation. The first and second electrical pulses may be 12 volt DC electrical pulses. The electric relay may be a 12 volt electric relay. The electric relay may be a double pole double throw relay. The electronic payment device may be selected from the group consisting of a PayRange Blue Key Plus device, a Pay Range Blue Key Smart device, a Touch Tunes device, and an AMI device. The electronic payment device may be connected to the electric relay via a wire being connected from a position on a relay board of the PayRange Blue Key Plus device to the electric relay. The relay board may be a Pay Range Relay Board part #8856046 and the position on the relay board may be a K1 position. The exemplary disclosed apparatus may further include a deep cell battery that may be electrically connected to the tracking device. The deep cell battery may be a 12 volt DC battery. The exemplary disclosed apparatus may also include a display board configured to be disposed on the machine, the display board including a plurality of light-emitting diodes. The tracking device may be a 12 volt DC coin counter. The tracking device may be a pool table tracking device or an automated teller machine tracking device.

In at least some exemplary embodiments, the exemplary disclosed system may include a pool ball release switch (e.g., operation assembly 315), an electric relay (e.g., relay 325) that may be connected to the pool ball release switch, a tracking device (tracking device 335) that may be connected to the electric relay, and an electronic payment device (e.g., payment device 330) that may be connected to the electric relay. The electric relay may be configured to transfer a first electrical pulse from the pool ball release switch to the tracking device. The electric relay may be configured to transfer a second electrical pulse from either the electronic payment device or the pool ball release switch to the tracking device. The relay may transfer the first electrical pulse or the second electrical pulse when the pool ball release switch releases a plurality of pool balls from a cavity of the pool table machine. The electric relay may be a 12 volt double pole double throw relay. The electronic payment device may be a PayRange Blue Key Plus device, a Pay Range Blue Key Smart device, a Touch Tunes device, or an AMI device that may be connected to the electric relay via a wire being connected from a position on a relay board of the electronic payment device (e.g., a PayRange Blue Key Plus device, a Pay Range Blue Key Smart device, a Touch Tunes device, or an AMI device) to the electric relay. The relay board may be a Pay Range Relay Board part #8856046 and the position on the relay board may be a K1 position.

The exemplary disclosed system, method, and apparatus may be used in any suitable application involving coin-operated and/or bill-operated machines. For example, the exemplary disclosed system, method, and apparatus may be used in any suitable application such as a pool table, an arcade or game center device (e.g., air hockey or any other desired machine), a machine for shaping and stamping coins (e.g., souvenir penny), a laundry machine, a gambling machine such as a slot machine, and/or any other desired machine that may operate based on inserting coins, bills, or other forms of payment. The exemplary disclosed system, method, and apparatus may also be used for efficient parking at stadiums, arenas, parking garages, designated municipal parking, and/or other suitable locations for parking vehicles.

Figure 4:
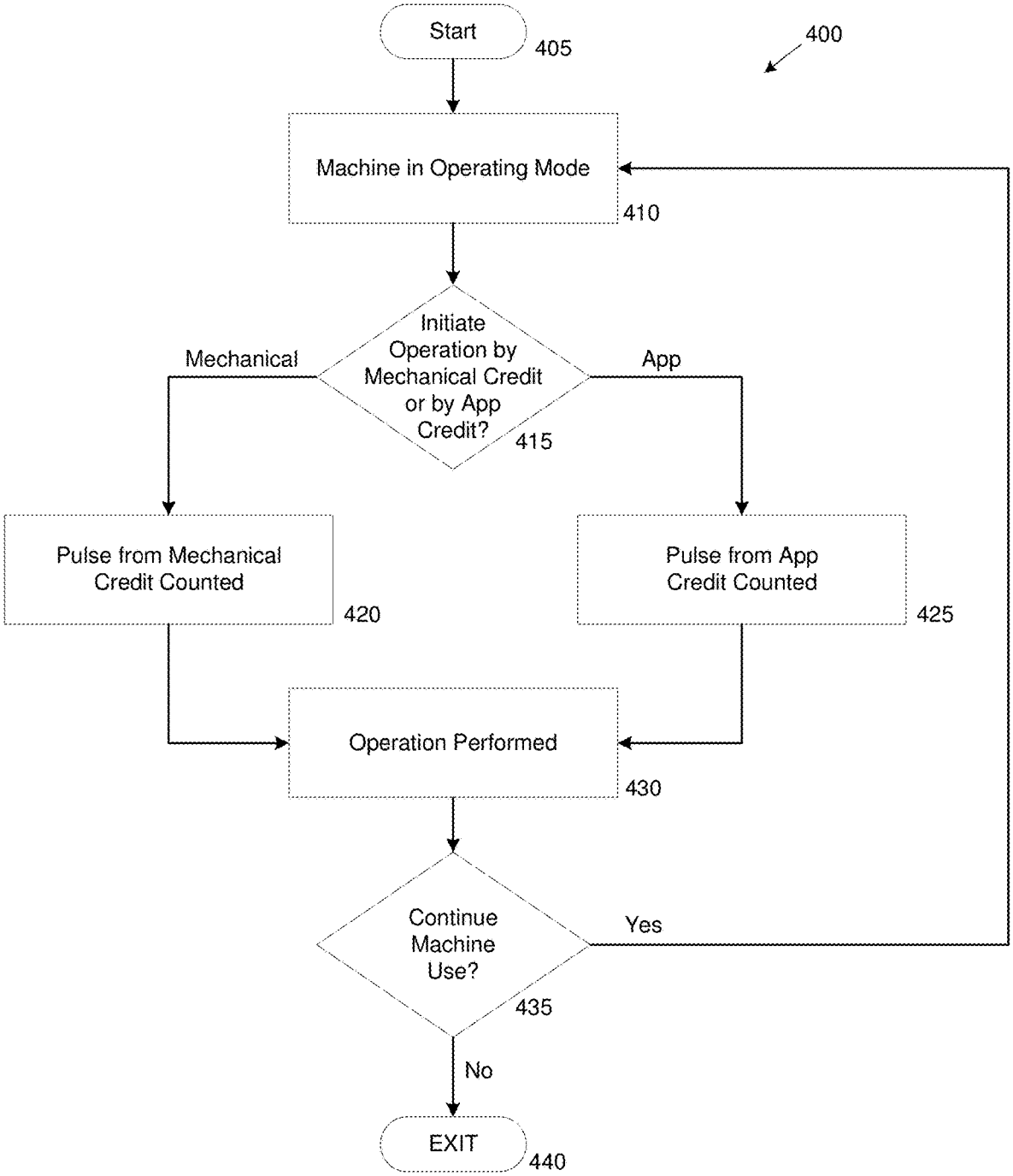
FIG. 4 illustrates an exemplary process of at least some exemplary embodiments of the present disclosure.

FIG. 4 illustrates an exemplary operation of the exemplary disclosed system 300. Process 400 begins at step 405. At step 410, system 300 may be in an operating mode. Both machine 305 and tracking system 310 may be powered on and available to receive input or interaction from users.

At step 415, an operation of machine 305 (e.g., an operation of operation assembly 315 such as dropping pool balls or an ATM operation) may be initiated. At step 415, system 300 may determine whether the operation has been initiated by a mechanical credit or an App credit (e.g., initiated using an application such as a smartphone app that may be processed via payment device 330). System 300 may determine how the operation has been initiated based on an operation of relay 325, tracking device 335, and/or controller 355, which may emit and/or receive pulses and/or pulse data from each other or other components of tracking system 310 and/or machine 305 (e.g., operation assembly 315) for example as described below. Step 415 may occur simultaneously with and/or be integrated with step 420 and/or step 425.

If system 300 determines that the operation (e.g., of operation assembly 315) has been initiated by mechanical credit, process 400 may proceed to step 420. At step 420, tracking device 335 may receive a pulse from operation assembly 315. For example when a user inserts coins or currency into operation assembly 315 and actuates operation assembly 315, operation assembly 315 may perform a desired operation (e.g., dropping pool balls) and emit an electrical pulse as described for example above (e.g., to tracking device 335 either directly or via relay 325). Tracking device 335 may measure (e.g., "count") and record data regarding the operation of operation assembly 315 (e.g., regarding any desired attribute such as the exemplary attributes described above). Process 400 may then proceed to step 430, at which the desired operation (e.g., operation of operation assembly 315) may be performed.

If system 300 determines that the operation (e.g., of operation assembly 315) has been initiated by App credit, process 400 may proceed to step 425. At step 425, tracking device 335 may receive a pulse from payment device 330 (e.g., and/or operation assembly 315). For example when a user initiates the operation for example as described above (e.g., via wireless commands provided to a smartphone or similar device), payment device 330 may emit an electrical pulse to operation assembly 315 to perform a desired operation (e.g., dropping pool balls), which may also be received by tracking device 335 either directly or via relay 325 (e.g., and/or operation assembly 315). Tracking device 335 may measure (e.g., "count") and record data regarding the operation of operation assembly 315 (e.g., regarding any desired attribute such as the exemplary attributes described above) and/or payment device 330. Process 400 may then proceed to step 430, at which the desired operation (e.g., operation of operation assembly 315) may be performed.

At step 430, the desired operation such as dropping of pool balls, a game ball being provided, a material or good being dispensed, or any other desired operation based on a purpose of machine 305 may be performed. In at least some exemplary embodiments, users may perform an activity (e.g., play a game) based on the operation. For example, pool players may shoot the balls that were dropped or released at step 430 into pockets of machine 305 that may be a pool table. For example objects 318 (e.g., pool balls) may be returned to the exemplary disclosed cavity of machine 305 described above.

System 300 may then proceed to step 435, at which system 300 may determine whether use of machine 305 will continue and whether machine 305 will remain in an operating mode based for example on user input, input from an owner and/or operator of machine 305 or property on which machine 305 is located, an algorithm or predetermined criteria provided to or by controller 355, machine 305 and/or tracking system 310 being physically powered off, and/or any other suitable input, criteria, conditions, or action. If system 300 determines that machine 305 will remain in use, process 400 may return to step 410. If system 300 determines that machine 305 will not remain in use, process 400 may proceed to step 440, at which process 400 ends.

Process 400 may involve any desired number of tracking systems 310 and/or machines 305. In at least some exemplary embodiments, a single tracking system 310 may track or monitor a single machine 305 or a plurality of machines 305. Also for example, a plurality of tracking systems 310 may track or monitor a single machine 305 or a plurality of machines 305. Data measured and stored by any desired number of tracking systems 310 regarding any desired number of machines 305 may be combined, analyzed, and/or processed by system 300 as desired. For example, data from one or more tracking systems 310 may be processed by system 300 to provide analysis results for one or more machines 305 such as number of operations, time of machine use, revenue, and/or other data by machine 305, location, and/or any other desired parameter. For example, system 300 may provide data and analysis regarding how machine 305 is utilized during free play or league play when machine 305 is a pool table. System 300 may utilize artificial intelligence or machine learning techniques (e.g., as described below) in analyzing the data recorded and/or processed by tracking system 310 (e.g., by tracking device 335).

In at least some exemplary embodiments, operation assembly 315 may pulse tracking device 335 and/or payment device 330. The pulsing may be used for audits using tracking device 335 (e.g., secondary) located in the machine (e.g., machine 305 such as a pool table). A component of machine 305 such as operation assembly 315 (e.g., a pool table harness of a Diamond pool table or other desired machine) may be re-wired to relay 325 (e.g. a Double Pole Double Throw 12 volt relay), which may trip tracking device 335 to cause operation assembly 315 to operate (e.g., to drop pool balls or take any other desired action). Any desired pulse (e.g., voltage amount such as 12 volts) may pull relay 325 by either a mechanical credit (e.g., as described above regarding step 420) or an App credit (e.g., as described above regarding step 425).

Tracking system 310 may be installed on and/or within machine 305 using new wiring and adding power storage 340 and relay 325. For example, one or more components of machine 305 may be modified. In at least some exemplary embodiments, payment device 330 (e.g., including a part such as a Pay Range Relay Board part #8856046) may be modified to operate with relay 325 (e.g., a 12 volt relay). For example, a relay of payment device 330 (e.g., a relay disposed at a Pay Range relay board location K1) may be removed. The installation may include jumping a 12 volt DC to pulse wires of payment device 330 (e.g., on a PayRange relay board) to relay 325. In at least some exemplary embodiments, a board (e.g., pulse board such as a Blue Key pulse board) may be modified to take 12 volts off of the K1 location to send to a plurality of relays (e.g., via relay 325 to three different relays) to initiate an operation of operation assembly 315 of machine 305 while maintaining an isolation of voltages (e.g., isolating a voltage of tracking system 310 from a voltage of machine 305).

In at least some exemplary embodiments, by being able to control some or all free play games and/or paid play games using the exemplary disclosed system, method, and apparatus, operators of the system may track game play and charge fees for events such as pool league night. Also with the capability of tracking device 335 (e.g., counter such as a 12 volt coin meter), system 300 may track and record data each time a game is initiated (e.g., every time the pool balls drop for a pool game).

In at least some exemplary embodiments, a given machine 305 may collect money, which may include ACH operators sharing from a bank account associated with a given location of machine 305. System 300 may also track the amount of free games that are being played.

In at least some exemplary embodiments, the exemplary disclosed method may include providing an operation assembly (e.g., operation assembly 315) of a game machine, connecting an electric relay (e.g., relay 325) to the operation assembly, connecting a tracking device (e.g., tracking device 335) to the electric relay, connecting an electronic payment device (e.g., payment device 330) to the electric relay, transferring a first electrical pulse from the operation assembly to the tracking device via the electric relay, transferring a second electrical pulse from either the electronic payment device or the operation assembly to the tracking device via the electric relay, and transferring the first electrical pulse or the second electrical pulse when the operation assembly releases at least one playing object of the game machine. The operation assembly may include a pool table switch that releases at least one playing object that may be a plurality of pool balls of the game machine that is a pool table. The operation assembly may include a mechanical push slot of the game machine that is a pool table. The exemplary disclosed method may further include connecting a battery to the tracking device, and selectively connecting the battery to an electrical outlet via an electrical wire.

In at least some exemplary embodiments, the exemplary disclosed system, method, and apparatus may operate with any suitable machine 305 (e.g., a Diamond pool table or any other suitable mechanical commercial pool table). Paid advertisements (e.g., ads) may be sold based on an operation of system 300 (e.g., via a network that interfaces with users such as the Internet). The exemplary disclosed system may also set a relatively cheaper game rate for pool league players to start games during league play (e.g., or have a sponsor that puts an ad on the app when they start the game to pay a portion of the fee). For example, pool league players may also pay a weekly fee that may give the players a certain number of free games per week using system 300. An operator of the exemplary disclosed system, method, and apparatus may also share some of the fees with an owner of a facility in which machines 305 are located (e.g., a bar room owner). The exemplary disclosed system, method, and apparatus may control the percentage of all fees via input provided by an operator and/or a predetermined operation (e.g., including machine learning operations as described below). For example, machines 305 (e.g., pool tables) at pool league locations (e.g., bars) may provide league players with practice time during slow business hours for free (e.g., hours during which a given location is typically slow or not crowded).

In at least some exemplary embodiments, the exemplary disclosed system, method, and apparatus (e.g., including Pay Range) may work with machines 305 such as pool tables, with a push message being selectively sent to an operator of the exemplary disclosed system and a location owner (e.g., location where one or more machines 305 are located) to plug in machine 305 (e.g., a pool table) so that power storage 340 powering tracking device 335 may not run out of power (e.g., will not run down).

In at least some exemplary embodiments, the exemplary disclosed system, method, and apparatus may track, audit, manage, and control league play. Operation assembly 315 that may switch an operation of machine 305 (e.g., a pool table) between free play and paid play may be disconnected and side door pool table keys may not be given out to control an opening and closing of a window to machine 305 (e.g., window to access pool balls). Accordingly, machine 305 may not be physically switched to a free play mode in some cases. Also for example if operation assembly 315 (e.g., a coin mechanism) breaks or jams, machine 305 (e.g., a pool table) may still be started using the exemplary disclosed component or application (e.g., including a PayRange app). This may save an immediate service call from being requested, and machine 305 (e.g., pool table) may remain in operation.

In at least some exemplary embodiments, the exemplary disclosed system, method, and apparatus may provide output and receive input from a system operator, a location owner of machine 305 (e.g., bar owner), and/or players via any suitable user interface as described for example herein. For example, users may access the system using a smartphone app. In at least some exemplary embodiments, the exemplary component or application (e.g., Pay Range) may use an internet connection via a mobile phone to operate (e.g., and/or any other suitable network connection as described for example below). For example, the exemplary disclosed system, method, and apparatus may operate using computing devices and networks similar to the exemplary devices and networks described below regarding FIGS. 15-17.

In at least some exemplary embodiments, the exemplary disclosed system, method, and apparatus may include using relay 325 that may be 12 volts DC and may be used on any suitable mechanical machine such as a game machine (e.g., pool table, arcade game, or other suitable game).

In at least some exemplary embodiments, the exemplary disclosed system, method, and apparatus may charge pool league players a fee each week so that the players may start their pool league games and practice when desired (e.g., at predetermined and/or flexible times) each week. Also for example, the exemplary disclosed system, method, and apparatus may set how many games each league player may initiate (e.g., start) each week by charging a fee when desired (e.g., a small fee each week).

In at least some exemplary embodiments, the exemplary disclosed system, method, and apparatus may include a waiting list feature. For example, an exemplary application (e.g., app) utilized by users may allow for a plurality of people (e.g., five people or any other desired number of people) to wait to play pool on an exemplary machine (e.g., machine 305). For example, a user may pay to play on machine 305, and the system may place them on a waiting list. The exemplary system may alert a user that machine 305 is available to play pool via the app (e.g., via an exemplary user interface as described for example herein that may run the app). For example, a user may initiate play on machine 305 via an exemplary user interface (e.g., via an app of a smartphone).

In at least some exemplary embodiments, the exemplary disclosed system, method, and apparatus may be used for pool tables or laundry machines. If a first user is using an exemplary machine (e.g., machine 305 such as a pool table or a laundry machine), a second user would not be able to utilize the system to initiate an operation of the machine.

For example, a user who wants to play machine 305 next or reserve a turn in-line on an exemplary machine (e.g., pool table or laundry machine) may use a user interface (e.g. running an app) to choose the exemplary waiting list feature. The user may use the app to swipe up on the waiting list, which may result in a code being sent back by the system to their user interface (e.g., smartphone). The exemplary code may work once a prior code (e.g., code of a prior user) has been used. If no other user is in front of the waiting user (e.g., on the waiting list) and other users are utilizing a machine, then the exemplary code may be able to be used as soon as the users in front of the waiting user(s) are finished using the machine. For example, some or all other codes may be inactive until the code in front of the waiting user is used. The exemplary system may allow users to fairly and correctly maintain an order of use of the exemplary machine (e.g., machine 305).

In at least some exemplary embodiments, the exemplary disclosed system may include an imaging device such as a monitor (e.g., similar to display assembly 320). The monitor may for example display a user who is next (e.g., users in a location such as a bar or laundromat may look at the monitor to see who is next). For example, a wiring of the exemplary disclosed system used to start the exemplary machine (e.g., machine 305) may be disconnected (e.g., Blue Key voltage may be disconnected using the exemplary disclosed wiring of an exemplary relay until a user pushes a start button). The exemplary machine could include instructions located by a light switch indicating to press "end game" to start the exemplary app described for example herein. Users may for example self-police use of the exemplary system described above. For example, users located near the exemplary machine may notice a light on the exemplary machine that may light up (e.g., light up brightly and/or flash), thereby indicating to nearby users to push the button to start the exemplary app to start the next game (e.g., or next use of the exemplary machine). The app may for example indicate that the exemplary machine is unavailable until the end game button is pressed by a user. The exemplary machine may also include instructions (e.g., located in the app) to check that the end game button was pushed. Once the Blue Key voltage is reconnected (e.g., back online) the next play in the exemplary waiting list may be accepted to swipe the app to start. The exemplary machines (e.g., machine 305) may also use a laser to detect a cue ball when machine 305 is a pool table. The exemplary system may include a second laser to detect an 8 ball and trip the Blue Key voltage back on if appropriate based on game play. The exemplary disclosed system may for example use latching relays to complete these transactions.

In at least some exemplary embodiments, the exemplary disclosed system, method, and apparatus may include display assembly 320 that may be a challenger control board and challenger player unit. Display assembly 320 that may be a challenge board may be mounted to an outside of machine 305 (e.g., a pool table exterior) in a metal housing. Display assembly 320 may have eight LED lights numbered from one to eight (e.g., single LED for 8, 9, and 10 ball forgiveness, and two low battery LEDs for D cell and main battery). Display assembly 320 that may be a challenge board player unit may also be used on other types of machines such as Fosse ball tables, Shuffle Board tables, dart boards, and dart machines to keep an order of players or similar games that involve maintaining a player order. Display assembly 320 that may be a Challenger Player unit may also be installed on any mechanical pool table such as Diamond, Valley, Dynamo, Brunswick, and Global pool tables.

In at least some exemplary embodiments, display assembly 320 that may be a challenge board may provide a Straight Pool Setting. For example, when a player inserts quarters or uses an app to pay as described for example above, vending Challenger LED 1 may light up solid. If no time play is set up on machine 305 that may be a pool table, then the LED will remain solid until someone puts money back in. When a first player ends his or her game, the next player may insert money or app credits. The Player 1 LED may then turn off (e.g., go out) and the player 2 LED may light up. There may be a 20 minute reset time (or other desired time). After 20 minutes, the LED for player 2 may go out. This may prevent power storage 340 (e.g., a battery) from being drained.

In at least some exemplary embodiments, display assembly 320 that may be a challenge board may provide timed pool settings. These settings involving timed play may make the LED Challenger LED lights operate differently. Money or an app may cause operation assembly 315 to activate to cause pool balls to drop. The Challenger LED 1 light may light up solid. When a time that may be set on the board by the owner of machine 305 has expired, the Challenger LED 1 may flash and a ball gate of machine 305 may close. The ball gate may not open up until cash or an App (e.g., via payment device 330) has been applied. Also the Challenger 2 LED may not light up solid until challenger 2 pays and then the challenger 1 LED may stop flashing. For example, once the challenger 1 LED stops flashing and the Challenger 2 LED lights up solid, then users know that Challenger 2 has paid. If no other user starts a game within a predetermined time period (e.g., within 20 minutes or any other desired time period), then the Challenger 2 LED may turn off until cash is added or an app is used to start a new game, which may reduce battery power usage.

In at least some exemplary embodiments, the exemplary disclosed system, apparatus, and method may include any suitable battery power preservation features. For example, when a component (e.g., a push slot) of operation assembly 315 is manipulated, the exemplary disclosed controller may control components of system 300 based on the manipulation. For example, operation assembly 315 may include a push slot that may be pushed in by a user to a predetermined position when money such as coins is not inserted into operation assembly 315. When such a component is pushed in without the insertion of money, a switch of system 300 disposed (e.g., inside of machine 305) next to the exemplary push slot may be actuated or activated, The switch may transfer data and/or an electrical pulse to tracking system 310 for example as described above, which may cause tracking system 310 to turn on (e.g., switch from a passive or sleep mode that may preserve battery power of tracking system 310 to an active or ready mode). When such a component is not pushed and system 300 is not in use by users for more than a predetermined time period, system 300 may remain in a passive or sleep mode in which battery power may not be used or battery usage may be negligible. This exemplary operation may result in power storage (e.g., power storage 340 of system 300) not being used when system 300 is not in use, which may result in power storage 340 being charged less often. In at least some exemplary embodiments when operation assembly 315 may include a drop coin assembly, system 300 may include a component (e.g., micro switch) disposed at or near (e.g., next to) a coin return lever that may be disposed inside machine 305. For example if a user pushes a coin return of operation assembly 315, the coin return may turn on power to tracking system 310 (e.g., turn on power to payment device 330 and/or send a notification via an app to a user device). Machine 305 may include instructions for activating the above described exemplary methods.

In at least some exemplary embodiments, display assembly 320 that may be a challenge board may include an eight ball forgiveness LED that may light up once money or an app credit is vended. Eight ball forgiveness may light up solid on either settings (e.g., straight pool or timed play) if the owner of the table has selected for it to be turned on. Next to (e.g., vertically next to) the eight ball LED may be a place for a sticker to let challengers know that the table has eight ball forgiveness available and active.

In at least some exemplary embodiments, display assembly 320 that may be a challenge board may include low battery level LEDs for power storage 340, which may provide notification to system operators to connect (e.g., plug in) power connector 345 to power source 350. The exemplary disclosed system may also include app monitoring of power storage 340 (e.g., battery levels), which may provide an owner or operator of machine 305 with real time alerts to charge or change power storage 340 and/or batteries of machine 305. By using the flashing LEDs as an indication for when a battery is low, a patron could also make the location aware that a table should be plugged in (e.g., as illustrated in FIG. 1). The LEDs lighting up when power storage 340 may be nearing unrecoverable battery levels may save the operator from expensive battery replacement costs. Display assembly 320 may also include audio alarms to notify users of low batteries. If a main battery of display assembly 320 or tracking system 310 drops to a low level, the board may disconnect the battery from a circuit and flip over to another power storage (e.g., cue ball laser battery)

until the main battery is charged or replaced. Also for example, machine 305 may be plugged into a power source and no batteries may be involved.

In at least some exemplary embodiments, display assembly 320 that may be a challenge board may provide for Free Game Challenge (FGC) Rules. Silk screened numbers 1 to 8 may be printed vertically in order on a chalk board or lit eraser marker board. Any other suitable printing technique may also be used. Players may put their name next to each number to correspond to the numbers on the FGC. Instructions and rules of the FGC may also be silk screened on the chalk board. By combining the LED challenger lights described above and the FGC, an order of play may be tracked and organized. The LED may give the next challenger the option to start the Pool table (e.g., initiate operation as described for example at step 415) with an app or coins (e.g., quarters) or currency. The FGC may also be used to create the order of challengers and to continue the order of play. For example, during a busy night of pool table play, customers may put their names on the chalk board next to the corresponding number on the FGC. Then customers may also place one quarter on their number on the FGC game board on display assembly 320 that may be the Challenger player unit. When some or all of the numbers are taken, the first player on the table that already has the table may be challenged by Challenger 1. If Challenger 1 wins then he or she may leave a marker (e.g., quarter) on Number 1. Then Challenger 2 may challenge Challenger 1. If Challenger 1 loses then he or she may take his or her quarter from the Challenger 1 slot and put it on the free game slot. If Challenger 2 wins again against Challenger 3, then Challenger 2 may leave his or her marker (e.g., quarter) on 2 again. Challenger 3 may then place his or her quarter on the Free Game slot. For example, if Challenger 2 wins all of his or her games, all eight marker (e.g., quarters) may be theirs for a free game or he or she may take the quarters if there are no more challengers.

In at least some exemplary embodiments, display assembly 320 that may be a challenge board may provide for Tournament Play. On a side (e.g., the left side) of a Challenger Player Unit there may be a key switch that may connect to display assembly 320 that may be the Challenger board. Below that key switch may be another coin meter. If machines 305 that may be pool tables are placed in a tournament, a tournament feature may be turned on with the key switch (e.g., as described further below regarding FIGS. 8-10), which may allow the pool balls to drop without any app or cash vend. The player may push an "8, 9, and 10 ball forgiveness" button to drop the pool balls to start a next game. The balls may then be locked in the pool table until the button is pushed again. Tracking device 335 that may be a coin meter disposed under operation assembly 315 that may be a switch may count every time the balls are dropped. If there is an app connected to display assembly 320 that may be a board then the app may record (e.g., capture) every time the balls dropped also. A predetermined fee may be agreed on to charge a person or entity running a Tournament, so the owner of machines 305 (e.g., the pool tables) may generate revenue. This feature may work with greens fee tournaments also. In at least some exemplary embodiments, a first operator may own machine 305 and a second operator (e.g., or the same operator) may own tracking system 310 that may be installed on machine 305.

The tournament feature may also be used with pool league night instead of using an app. A location hosting machines 305 may be charged (e.g., half price) every time an operation of operation assembly 315 is initiated (e.g., the balls drop). By using tracking device 335 (e.g., the meter on the player unit) the vendor may charge the location for league play. The Tournament feature may also be used in pool halls so a customer may be charged per game without any money or app fee being paid directly. For example, a pool hall may still charge a fee per player or charge a fee per every time operation assembly 315 is initiated (e.g., the balls are dropped).

A combination of some or all of the exemplary disclosed functions (e.g., on a "BarZcash" system) in the use of the exemplary disclosed app, including using display assembly 320 (e.g., LEDs on the Challenger board) and the FGC to control pool play and player order. The exemplary disclosed system, method, and apparatus may provide a technique for tracking and monetizing league pool play.

In at least some exemplary embodiments, the exemplary disclosed system, method, and apparatus may also provide a ball forgiveness feature for a commercial pool table for example by using a push button switch. Once players know that one of the three balls go in (e.g., 8, 9 or 10) they may push the forgiveness button and activate operation assembly 315 (e.g., drop the balls) again. If the game is set on straight pool, for example, the forgiveness button may be pushed a single time. There may be a 10 minute time period (e.g., or any other desired time period), so if a forgiveness LED (e.g., on display assembly 320) goes out then time has run out and the forgiveness button will not work anymore. The three balls may be used in three different games (e.g., classic eight ball, nine ball and ten ball). For example, the exemplary disclosed system (e.g., including apps) may provide for adjustable play times and tracking every game on tracking device 335 (e.g., an electromechanical coin meter) so that an operator (e.g., of tracking system 310 and/or machine 305) may charge a fee per a game to a location owner. Also, league players may be charged at a reduced price instead of not paying anything.

In at least some exemplary embodiments, the exemplary disclosed system, method, and apparatus may also include display assembly 320 that may be a Universal board having many settings. Users can enter input to system 300 to have a pool table sense the 8, 9, and 10 ball or use a manual push button switch. This may give a player another game free of charge. This option may be designed so that the pool table price can be raised to cost more money than traditional pricing. Also for example, if a pool game is set up on a 5 minute game (or any other desired time) and an 8 ball goes in after 5 minutes expires, then the balls will not release. A tournament setting may also be combined with a forgiveness setting so that every time an 8, 9, or 10 ball goes in a pocket, depending on the selected game, the balls will drop and the customer may push the button once the 8, 9, 10 ball are sunk in the game. After the balls drop, the ball gate may go down again until the button is pushed again. For accounting and collecting revenue, tracking device 335 may keep track of each initiation of operation assembly 315 (e.g., every time the balls drop). By having tracking device 335 count games, a pre-determined fee for the location owner to pay could be agreed upon (e.g., based on tracking device 335 that may be a coin meter, for example when a tournament is set up for green fees instead of putting money in the table). Every time the ball gate goes up may be tracked on the exemplary disclosed app. The tournament feature may also be used in pool halls, which may charge by the hour. The customer may also choose to pay a minimum fee and be charged per each time operation assembly 315 operates (e.g., every time the ball gate drops the balls). This may be controlled by the app, so if the customer chooses a minimum fee then it would start the table with the app.

In at least some exemplary embodiments, the exemplary disclosed system, method, and apparatus may provide for PayRange, Touch Tunes, and/or AMI application Integration with a BarZcash Universal Board and Retro Kit System. With the production of the BarZcash Universal board for the PayRange app, Touch Tunes app, and/or AMI juke box app, a wide array of opportunities may be taken advantage of on Pool Tables, Amusement machines, and other machines. The universal board may be to create a way to channel pool league players to use PayRange, Touch Tunes and/or AMI applications to start pool tables and track the pool table plays. With the exemplary disclosed universal board, league players may be charged at a reduced price and the operator of machines 305 may recover some payment for the maintenance of the pool tables. For example, every vended app, cash, free game and tournament play may be counted by tracking device 335 that may be an electromechanical coin meter. In doing so, the operator may charge for an app connection fee and keep track of some or every vending event. For example, an operator may pay BarZcash a monthly fee or a percentage of each vend (e.g., app fees may be taken out of the app vends automatically). If no app is connected to machine 305 (e.g., a pool table), tracking device 335 (e.g., a challenger coin meter) may be used to charge a pool table location or tournament manager at a predetermined fee per drop of the balls by the Challenger player ball drop button. Also for example, the 8, 9, and 10 ball forgiveness option may be turned on as described for example above to generate additional revenue per pool game.

In at least some exemplary embodiments, an operator of system 300 may set up apps for sharing between Touch Tunes, PayRange, and/or AMI. The operator may set up incentives for other machines co-located with machine 305 (e.g., pool tables, arcade games, jukeboxes, and any other suitable device located in a given location) such as buying 5 songs on a juke box to get a free game of pool or discounted game of pool (e.g., or any other offer or benefit).

In at least some exemplary embodiments, if power storage 340 that may be a battery (e.g., for a board of tracking device 335) is disconnected, batteries (e.g., "D" Cell batteries) that power a laser eye (e.g., cue ball laser eye) may automatically switch to power the board. Also for example, a 12 volt wall charger may be plugged into power storage 340. Also, a 12 volt charger may be plugged into the board (e.g., to bypass or avoid use of batteries).

In at least some exemplary embodiments and as illustrated in FIG. 1, a sensor 360 (e.g., a motion sensor or any other suitable sensor such as a light sensor) may turn on power to a PayRange, Touch Tunes, and/or AMI app unit via tracking device 335 and/or relay 325. Motion sensor 360 may be disposed on a Challenger board of machine 305. If no motion is detected for 30 minutes after any app credit or money is inserted or provided, system 300 (e.g., including apps) may power off to conserve power of power storage 340 (e.g., battery life). The motion sensor may be controlled by controller 355 and/or tracking device 335.

In at least some exemplary embodiments and as illustrated in FIG. 1, system 300 may include a solar battery charging system. For example, one or more solar panels 365 may be placed on an angle on the sides of machine 305 (e.g. a pool table) under the skit of the rail so as to not get in way of players. Solar panels may also be located in rails for charging power source 340 (e.g., or other batteries of machine 305).

In at least some exemplary embodiments, display assembly 320 may include a challenger phone charging erasable chalk board (e.g., with app). The Challenger phone charging chalk board may have similar features as the exemplary disclosed Challenger Player unit described above, and may include a quarter rack with the one through eight quarter slots so that it may also be used with other gaming machines like Fosse ball, Shuffle Board and darts. The exemplary disclosed phone charging chalk board may maintain a player order and have a chalk board attached to it where one to eight players may write their names to maintain order of play. The exemplary disclosed phone charging chalk board may include an app on board that may power USB charger ports so players may charge their phones. A wireless charging spot may also be on the unit. The chargers may activate (e.g., power or turn on) via an app and have a timed limit before payment (e.g., another payment) would be made. This may also be sponsored by a company that would like to advertise and not charge the players for charging. For example, advertisers, may have the players go to a website to get the charger to turn on for free or offer a discounted price. There also may be an added shelf to the Challenger Player Unit so that two or three phones may rest on the shelf to get charged. The exemplary disclosed unit may plug in (e.g., into A/C or AC power) and also be adjustable to a size of the chalk board that may fit on it.

In at least some exemplary embodiments, the exemplary disclosed system, method, and apparatus may include a tracker (e.g., a Barzcash Universal Board Vaultracker) for automated teller machines (ATM). The exemplary disclosed system, method, and apparatus may include a universal board (e.g., similar to a board of tracking device 335 as described for example herein) that may track employee arrival and leaving times from ATM locations and track ATMs that have been stolen. The exemplary disclosed system, method, and apparatus may include a battery backup that may be activated once an ATM is disconnected from power (e.g., from AC electricity or power). When AC power is on, a relay (e.g., similar to relay 325) to the battery backup may be open. A relay coil may be pulled to maintain power being provided to the board (e.g., similar to a board of tracking device 335 as described for example herein). Once AC to the ATM turns off, the coil relaxes and puts a DC source (e.g., between 9 volts DC and 24 volts DC) to the app and the universal board. After this occurs, an app of the exemplary disclosed system may be activated to record what happens before or while the ATM is not powered (e.g., unplugged from AC power). Any opening of the Vault door (e.g., main door for paper) and/or other electronic accessibility normally accessed by service technicians will be measured and counted by the app of the exemplary disclosed system (e.g., a time of opening and a time of closing of the door or other access point). There may also be an interlock switch mounted to a fastener (e.g., stud) that may secure the ATM to the ground. If the ATM is removed from its location (e.g., the fastener connection is broken or removed), the exemplary disclosed system may measure and record on when it happened and any other desired information.

In at least some exemplary embodiments, an ATM employee may arrive at a location. When the employee open the vault door, the exemplary disclosed system may record that time. When the employee closes the door, the exemplary disclosed system may record that time. If the employee opens a top door to load paper at that time, the exemplary disclosed system may record data of that activity. When the employee is done servicing the ATM, the employee may perform a transaction (e.g., on the app) to activate the universal board (e.g., similar to a component of tracking device 335). All of the times and data that were recorded may be processed by the exemplary disclosed system (e.g., may be sent to system apps online so a manager may check the progress of the employee). For example, the exemplary disclosed system may accordingly detect an activity in which a person knows a combination of the ATM and unplugs the ATM before the person opens the vault door (e.g., the exemplary disclosed system may track the unauthorized vault opening). Based on data provided by the exemplary disclosed system, the manager may request certain timed footage of security system at that location at the time provided by the exemplary disclosed system. The manager may then determine who had opened the ATM in an unauthorized manner. The unauthorized person may also not be aware that the unauthorized access was detected.

Figure 5:
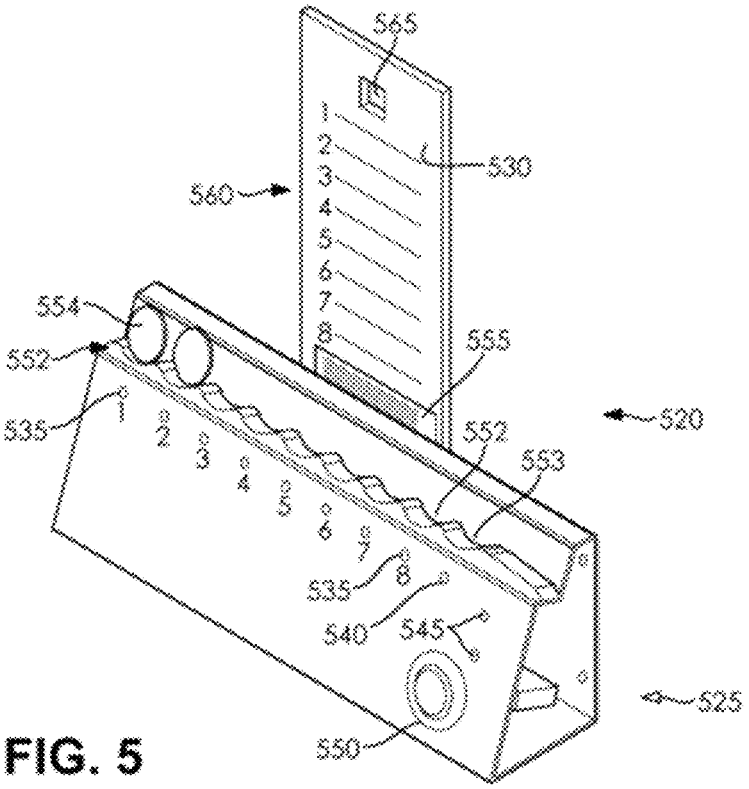
FIG. 5 is a perspective illustration of an exemplary embodiment of the present disclosure.
Figure 6:
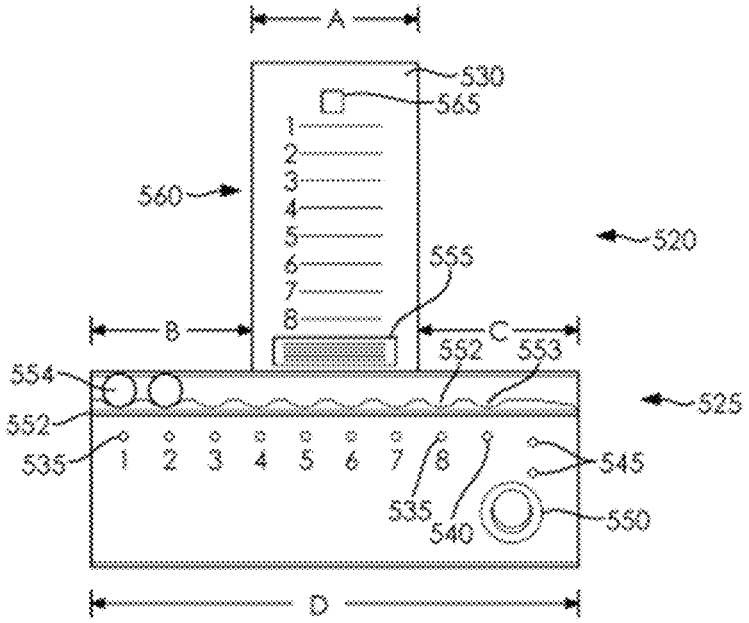
FIG. 6 is a front illustration of an exemplary embodiment of the present disclosure.
Figure 7:
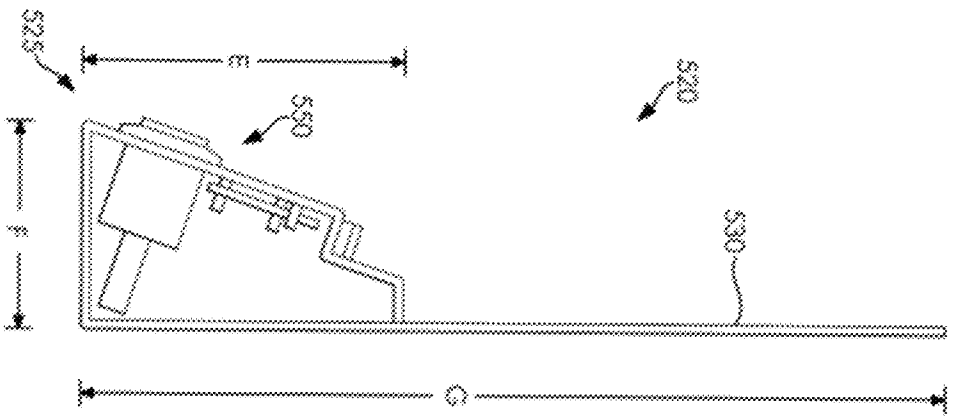
FIG. 7 is a side illustration of an exemplary embodiment of the present disclosure.

FIGS. 5-7 illustrate another exemplary embodiment of the exemplary disclosed system, method, and apparatus. Display assembly 520 may operate with system 300 in a manner similar to as described above regarding display assembly 320. For example, display assembly 520 may operate generally similarly to display assembly 320 (e.g., with other components of system 300) for example as described herein. Display assembly 520 may include an indicator assembly 525 and a display member 530. Display member 530 may be fixedly or removably attached to indicator assembly 525. Display member 530 may also be integrally formed with indicator assembly 525.

Display assembly 520 may be used to indicate an order of use of machine 305 by a plurality of users. For example when machine 305 is a game, display assembly 520 may be used to indicate to users an order of play to be followed by users of machine 305. For example, display assembly 520 may be used on machine 305 that may be a pool table (e.g., mechanical pool table such as Diamond, Valley, Dynamo, Brunswick, and Global pool tables), Fosse ball table, Shuffle Board table, dart board, dart machine, or other type of game machine to maintain an order of players.

Display assembly 520 may be made from any suitable materials for providing an interactive display for users such as, for example, plastic material, metallic material, composite material, wood, and/or any other suitable structural material. For example, display assembly 520 may be formed from polymer materials and plastic materials, e.g., thermoplastic and thermosetting polymers, resins and elastomers, polyethylene, polystyrene, polypropylene, epoxy resins, phenolic resins, hard plastic material, and/or any other suitable material having desired strength for forming structural components.

Display assembly 520 may have any suitable dimensions and/or configuration for being mounted on, at, or near a machine such as machine 305. For example as illustrated in FIGS. 5-7, display member may have dimensions "A" (e.g., between about 3" and about 4", e.g. about 3.5"), "B" (e.g., between about 3" and about 4", e.g. about 3.64"), "C" (e.g., between about 3" and about 4", e.g. about 3.61"), "D" (e.g., between about 10" and about 12", e.g. about 10.75"), "E" (e.g., between about 3" and about 5", e.g. about 4.03"), "F" (e.g., between about 2" and about 3", e.g. about 2.53"), and "G" (e.g., between about 10" and about 12", e.g. about 11.04").

Display assembly 520 may be mounted to an exterior of machine 305, partially within machine 305, or at a position near machine 305 (e.g., on a wall or stand). As illustrated in FIG. 3, display assembly 520 (e.g., or display assembly 320) may be in communication with one or more components of system 300. In at least some exemplary embodiments, display assembly 520 may be contained in a plastic or metal housing that may be attached to an exterior of machine 305 (e.g., a pool table exterior).

Indicator assembly 525 may include a controller similar to controller 355 that may control an operation of display assembly 520, and/or a power connector and a power source similar to power connector 345 and power storage 340 that may provide power to display assembly 520. Also for example, display assembly 520 may be selectively connected to (e.g., communicate with) tracking system 310 and/or machine 305 and controlled by controller 355 and powered by power source 350 and/or power storage 340.

Indicator assembly 525 may include a plurality of indicators 535. Indicators 535 may be any suitable component or device for providing an indication to a user such as a light, an audio component, and/or any other suitable devices for providing an indication to users. For example, indicator 535 may be a light-emitting diode (LED), an incandescent light component, or any other suitable lighting element. In at least some exemplary embodiments, indicator assembly 525 may include a plurality of indicators 535 (e.g., any desired number such as between two and twelve indicators 535, e.g., eight indicators 535). For example, indicator assembly 525 may include eight indicators 535, which may be numbered as illustrated in FIGS. 5 and 6 (e.g., numbered from "1" to "8" by markings such as etching, decals, or any other suitable marking disposed on or in a surface of indicator assembly 525).

Indicator assembly 525 may also include one or more indicators 540 and one or more indicators 545. Indicators 540 and 545 may be similar to indicator 535. Indicator 540 may be a game function indicator. For example, indicator 540 may be an "8, 9, and 10 ball forgiveness" indicator when display assembly 520 is used on machine 305 that may be a pool table. Indicator 545 may be a battery indicator (e.g., low battery indicator). For example, indicator assembly 525 may include a plurality of indicators 545 (e.g., two indicators 545) that may indicate a low battery status of a plurality of batteries of system 300 (e.g., power storage 340 for example as described herein, a D cell battery, a main battery, and/or any other suitable battery). In at least some exemplary embodiments, indicators 545 may be a plurality of low-battery-warning light-emitting diodes.

Indicator assembly 525 may also include an actuator 550. Actuator 550 may be any suitable actuator or other device for being actuated by a user of display assembly 520. For example, actuator 550 may be a button, a switch, a dial, or any other suitable mechanical device, electromechanical device, electrical device, or other suitable device that may be actuated by a user. A user may actuate actuator 550 to cause any desired action associated with machine 305 and/or tracking system 310. For example, actuator 550 may cause an operation of operation assembly 315 for example as described above to be performed. In at least some exemplary embodiments (e.g., when machine 305 is a pool table), actuator 550 may be a button such as a push-button that when actuated causes operation assembly 315 that may be a pool ball assembly to release a plurality of pool balls. Actuator 550 may be an "8, 9 and 10 ball forgiveness" button that may be pushed during a game of pool when machine 305 is a pool table to release a plurality of balls to a user (e.g., restart a game of pool).

Indicator assembly 525 may also include a plurality of recesses 552 that may be configured to receive one or more objects 554 (e.g. markers, coins, chips, or other suitable objects for use with a game or activity of machine 305). For example, indicator assembly 525 may include a plurality of recesses 552 that may be aligned with (e.g., and correspond to) indicators 535 and may be configured to receive objects 554 that may be quarters or other coins. Indicator assembly 525 may also include a recess 553 that may be similar to recess 552 and may be a free game spot for example as described below.

Display member 530 may be attached to indicator assembly 525 and may display any desired information to users of display assembly 520. For example, display member 530 may include marking 555 that may be printed characters, etched characters, silk screened characters, a decal or sticker including characters, or any other desired text or characters. Marking 555 may be game rules or use instructions for playing a desired game or engaging in a desired use of machine 305 (e.g., instructions on how to play a variant of pool or billiards, how to play a type of dart game, how to play air hockey, or any other game associated with a given machine 305).

Display member 530 may also include a plurality of markings 560. Markings 560 may be text or characters having numbers corresponding to indicators 535 (e.g., numbered indicators 535 as illustrated in FIGS. 5 and 6). For example, markings 560 may be printed characters, etched characters, silk screened characters, or any other type of characters (e.g., stickers or decals) that may be numbers or other characters corresponding to a numbering of indicators 535. Display member 530 may be a chalk board, a lit eraser marker or dry erase board, a smart board, an LED or LCD display, or any other suitable display board. Markings 560 may be silk screened numbers (e.g., 1 to 8) that may be printed (e.g., printed vertically) in sequential order on display member 530. Players using machine 305 may write or type their name (e.g., using chalk, dry erase markers, or typing using an electronic user interface) next to their respective number on display member 530 that may correspond to the numbers or characters on indicator assembly 525. Display member 530 may thereby help users or players to recognize and interpret indicators 535, 540, and 545 during an operation of display assembly 520, machine 305, and/or tracking system 310. In at least some exemplary embodiments, display member 530 may include an aperture 565 that may for example be used to mount or hang display assembly 520.

Figure 8:
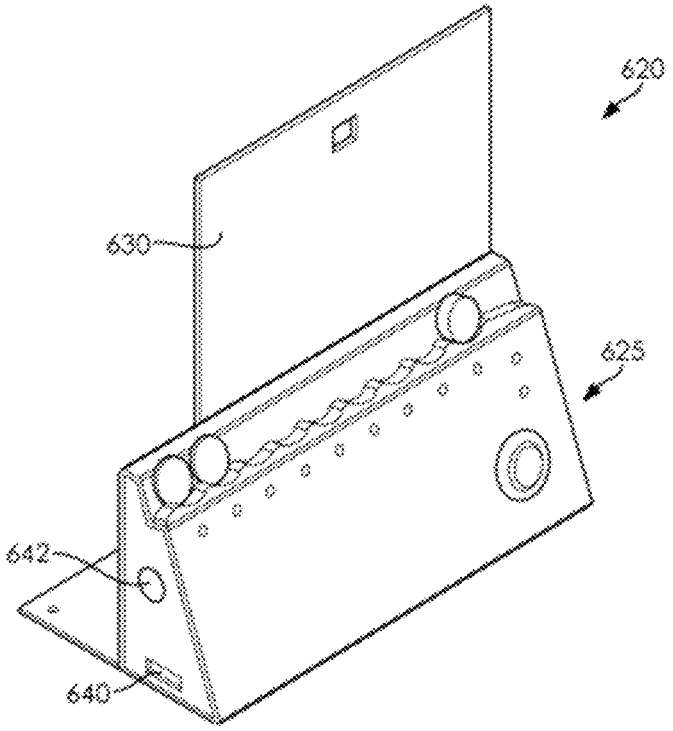
FIG. 8 is a perspective illustration of an exemplary embodiment of the present disclosure.
Figure 9:
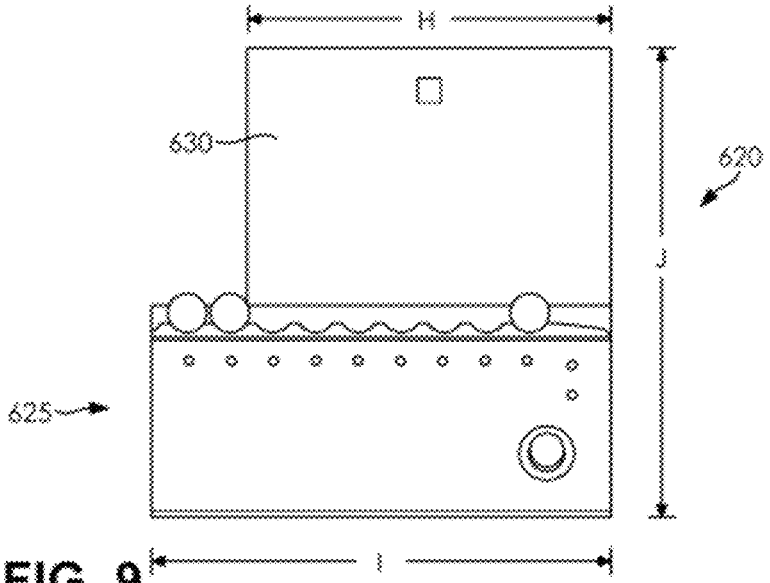
FIG. 9 is a front illustration of an exemplary embodiment of the present disclosure.
Figure 10:
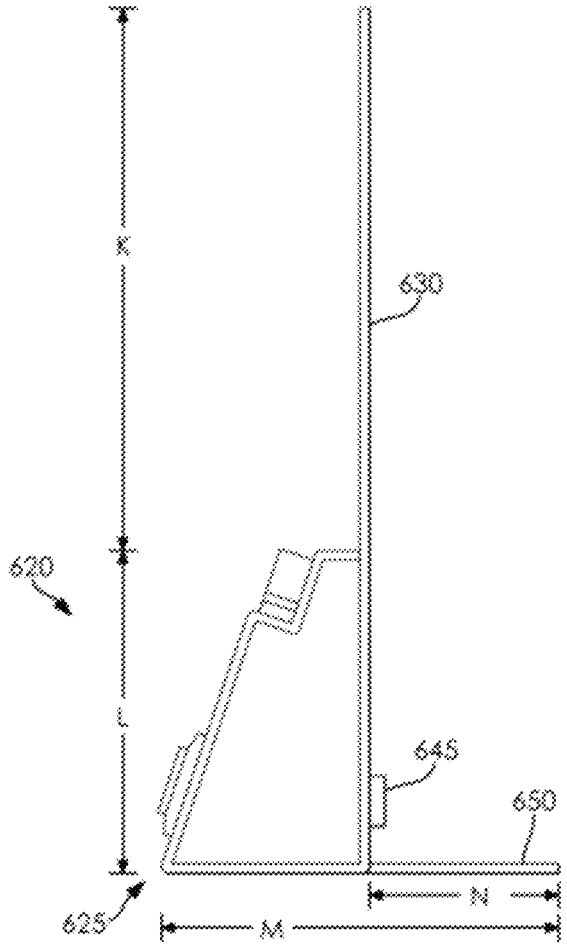
FIG. 10 is a side illustration of an exemplary embodiment of the present disclosure.

FIGS. 8-10 illustrate another exemplary embodiment of the exemplary disclosed system, method, and apparatus. Display assembly 620 may include an indicator assembly 625 and a display member 630 that may be generally similar to and include similar components (e.g., similar to indicators 535, 540, and 545, actuator 550, recess 552 configured to receive object 554, markings 555 and 560, and aperture 565) as indicator assembly 525 and display member 530 for example as described above.

Indicator assembly 625 may include a communication component 640. Communication component 640 may be disposed at any desired portion of indicator assembly 625 (e.g., any desired surface). For example as illustrated in FIG. 8, communication component 640 may be disposed at a side portion of indicator assembly 625. Communication component 640 may connect to components of tracking system 310 via any suitable wireless or wire communication (e.g., similar to for example as described herein). In at least some exemplary embodiments, communication component 640 may include a key switch that may connect to tracking system 310 (e.g., may allow the exemplary disclosed display assembly to communicate with components of tracking system 310). Communication component 640 may also include a tracking device that may be similar to tracking device 335. An operator of display assembly 620 may selectively activate communication component 640. For example during tournament play using one or more machines 305, an operator of display assembly 620 may activate (e.g., turn on via a key switch) communication component 640 to communicate with tracking system 310. In at least some exemplary embodiments, communication component 640 may be a tournament meter that may be controlled by a key switch 642 (e.g., DPDT key switch) that may be mounted above communication component 640 that may be the tournament meter. Communication component 640 that may be the tournament meter may count when key switch 642 is turned on. A main counter disposed inside machine 305 may count substantially all (e.g., every) drop of the pool balls. A key of key switch 642 may be taken out in a plurality of positions (e.g., on and off). Tracking system 310 may track how many times communication component 640 that may be the tournament counter counts the ball drops so that this exemplary count may also be tracked from the exemplary disclosed app. Key switch 642 (e.g., the Tournament key switch) may operate with or without the app hooked up.

As illustrated in FIG. 10, indicator assembly 625 may also include one or more electrical components 645. Electrical component 645 may be any suitable component for providing electrical power (e.g., to a device) such as a charger port for an electronic device. For example, electrical component 645 may be a USB charging port, a wireless charging device, or any other suitable device for charging a device (e.g., such as a smartphone). Display assembly 620 may include a member 650 that may be attached to indicator assembly 625 and/or display member 630. Member 650 may be a plate or shelf for supporting one or more devices (e.g., a user device such as a phone, smartphone, or tablet) for example when the one or more devices are being charged by one or more electrical components 645. For example, a plurality of user devices (e.g., two, three, or more phones) may rest on member 650 as they are charged.

Display assembly 620 may have any suitable dimensions and/or configuration for being mounted on, at, or near a machine such as machine 305. For example as illustrated in FIGS. 8-10, display member may have dimensions "H" (e.g., between about 7" and about 11", e.g. about 8.5"), "I" (e.g., between about 9" and about 12", e.g. about 10.75"), "J" (e.g., between about 9" and about 13", e.g. about 11.95"), "K" (e.g., between about 5" and about 7", e.g. about 6.05"), "L" (e.g., between about 4" and about 6", e.g. about 5.00"), "M" (e.g., between about 4" and about 7", e.g. about 5.73"), and "N" (e.g., between about 2" and about 4", e.g. about 2.95").

Display assembly 520 may include components similar to communication component 640, electrical component 645, and member 650. For example, components similar to communication component 640 and electrical component 645 may be disposed at desired surfaces of indicator assembly 525, and a member similar to member 650 may be attached to indicator assembly 525 and/or display member 530.

An exemplary operation of the exemplary disclosed display assembly will now be described. Although the exemplary operation is described using display assembly 520, display assembly 620 may also exhibit similar features during operation.

Display assembly 520 (e.g., or display assembly 620) may operate in a straight pool mode or setting. A user (e.g., a player) may insert bills or coins (e.g., quarters) or use an app to pay and to drop pool balls to play (e.g., via an operation of operation assembly 315). A first indicator 535 (e.g., marked "1" in FIGS. 5 and 6 such as a "Challenger LED 1") may make a first indication (e.g., light up solid) for example when the balls drop. If time play has not been set up on machine 305 that may be a pool table, then LED 1 may remain solid until another user pays to use machine 305. When the first player (or set of players or users) ends the game, a next player may insert money or put up app credits to activate operation assembly 315 to drop balls. The first indicator 535 (e.g., marked "1" in FIGS. 5 and 6 such as a "Challenger LED 1") may go out and a second indicator 535 (e.g., marked "2" in FIGS. 5 and 6 such as a "Challenger LED 2") may light up. Display assembly 520 may operate based on a predetermined reset time (e.g., 20 minutes). For example, after 20 minutes the second indicator 535 (e.g., marked "2" in FIGS. 5 and 6 such as a "Challenger LED 2") may go out. For example, if machine 305 is not being used for a period longer than the reset time, indicators 535 may go out, which may prevent the exemplary disclosed batteries powering display assembly 520 from being drained.

Display assembly 520 (e.g., or display assembly 620) may operate in a timed pool mode or setting. A user (e.g., a player) may insert bills or coins (e.g., quarters) or use an app to pay and to drop pool balls to play (e.g., via an operation of operation assembly 315). A first indicator 535 (e.g., marked "1" in FIGS. 5 and 6 such as a "Challenger LED 1") may make a first indication (e.g., light up solid). Display assembly 520 may operate based on a predetermined reset time (e.g., 20 minutes for example as set by an owner of system 300). When the predetermined reset time (e.g., 20 minutes) has expired, first indicator 535 (e.g., marked "1" in FIGS. 5 and 6 such as a "Challenger LED 1") may flash or make any other suitable predetermined action to notify users, and operation assembly 315 may no longer operate (e.g., operation assembly 315 that may be a ball gate may close). Operation assembly 315 may not operate (e.g., operation assembly 315 that may be a ball gate may not open up until cash or app money has been vended). Also for example, a second indicator 535 (e.g., marked "2" in FIGS. 5 and 6 such as a "Challenger LED 2") may not light up solid until a second user (e.g., "challenger two") pays, which may cause the first indicator 535 (e.g., marked "1" in FIGS. 5 and 6 such as a "Challenger LED 1") to stop flashing. Accordingly, once the first indicator 535 (e.g., marked "1" in FIGS. 5 and 6 such as a "Challenger LED 1") stops flashing and the second indicator 535 (e.g., marked "2" in FIGS. 5 and 6 such as a "Challenger LED 2") lights up solid then users may be notified that the second user (e.g., "challenger two") has paid.

In at least some exemplary embodiments, indicator 540 that may be an "8, 9, and 10 ball forgiveness" indicator may light up once money or an app is vended as described for example herein. For example, indicator 540 (e.g., eight ball forgiveness) may activate (e.g., light up solid) on the straight pool mode or setting and/or the timed pool mode or setting if an operator of system 300 has selected indicator 540 to be turned on (e.g., based on providing input to the exemplary disclosed controller and/or indicator assembly 525). In at least some exemplary embodiments, an indicator such as a sticker or other suitable marking may be placed near indicator 540 (e.g., next to indicator 540, for example vertically) to notify users (e.g., let challengers know) that machine 305 has eight ball forgiveness and that eight ball forgiveness has been activated.

In at least some exemplary embodiments, indicator 545 that may be a low battery indicator that may flash and/or make any other suitable warning to notify users (e.g., players and/or an owner of machine 305) that a battery of system 300 is low and that power connector 345 should be plugged into power source 350 (e.g., or batteries should be serviced or recharged before reaching unrecoverable battery levels). An app of system 300 may also warn users (e.g., via a user device such as a smartphone) of low battery levels.

In at least some exemplary embodiments, system 300 may operate in a free game challenge (FGC) mode or setting. The free game challenge mode or setting may utilize display assembly 520 (e.g., and tracking system 310) to keep track of player order of users of machine 305. A user (e.g., a player) may insert bills or coins (e.g., quarters) or use an app to pay and to drop pool balls to play (e.g., via an operation of operation assembly 315). Actuator 550 may also be pressed to start the game for example as described herein. Users may write or enter their names at markings 560 for example as described above. Users may also place a respective object 554 at recess 552 corresponding to their name at respective marking 560 (e.g., "challenger two" who writes his or her name at marking 560 labeled "2" may put his or her object 554 at recess 552 labeled "2"). When some or all markings 560 are taken, a user already playing on machine 305 may be challenged by "Challenger 1" (e.g., who may have written his or her name at marking 560 labeled "1" and may have put his or her object 554 at recess 552 labeled "1" at which that indicator 535 may be lit) and play a game using machine 305.

If "Challenger 1" wins the game, he or she may leave his or her object 554 (e.g., a coin such as a quarter) on recess 552 labeled "1." Then, "Challenger 2" (e.g., who may have written his or her name at marking 560 labeled "2" and may have put his or her object 554 at recess 552 labeled "2") may challenge "Challenger 1." A user (e.g., "Challenger 2") may insert bills or coins (e.g., quarters) or use an app to pay and to drop pool balls to play (e.g., via an operation of operation assembly 315). Actuator 550 may also be pressed to start the game for example as described herein. If "Challenger 1" loses the game with the first user, then he or she may remove his or her object 554 from recess 552 labeled "1" and place it on recess 553 (e.g., the free game spot). "Challenger 2" may leave his or her object 554 in recess 552 labeled "2" at which indicator 535 may be lit. After winning against "Challenger 1," "Challenger 2" may play "Challenger 3" (e.g., who may have written his or her name at marking 560 labeled "3" and may have put his or her object 554 at recess 552 labeled "3" at which indicator 535 may be lit). A user (e.g., "Challenger 3") may insert bills or coins (e.g., quarters) or use an app to pay and to drop pool balls to play (e.g., via an operation of operation assembly 315). Actuator 550 may also be pressed to start the game for example as described herein. If "Challenger 2" wins against "Challenger 3," "Challenger 2" may again leave his or her object 554 in recess 552 labeled "2." "Challenger 3" may remove his or her object 554 from recess 552 labeled "3" and place it on recess 553 (e.g., the free game spot for example on top of object 554 placed by "Challenger 1").

Gameplay may continue similarly to as described above. Indicator 535 corresponding to the current challenging player (e.g., according to the numbering for example illustrated at FIGS. 5 and 6) may be lit during the game in which that challenger is challenging the winner of the previous game (e.g., indicator 535 numbered "5" may be lit while "Challenger 5" is challenging the winner of the previous game). After each game, the player who wins may leave his or her object 554 in recess 552 marked with his or her number at his or her recess 552, and the player who loses may move his or her object 554 to recess 553 (e.g., the free game spot). Eventually, objects 554 (e.g., quarters) of all but one player may be moved to recess 553 (e.g., the free game spot). For example continuing the example above regarding "Challenger 2," it "Challenger 2" wins the remaining games against "Challenger 4" through "Challenger 8" (e.g., or any desired number of challengers), objects 554 of all of the other players other than "Challenger 2" may be placed in recess 553 (e.g., the free game spot). "Challenger 2" may then take objects 554 (e.g., may retain the value of objects 554 that may be markers, chips, or coins, or play a free game on machine 305 by inserting objects 554 into operation assembly 315).

In at least some exemplary embodiments, system 300 may operate in a tournament play mode or setting. Users may activate communication component 640 for example as described above to connect the exemplary disclosed display assembly (e.g., display assembly 320, display assembly 520, or display assembly 620) to components of tracking system 310. For example, the exemplary disclosed display assembly (e.g., display assembly 320, display assembly 520, or display assembly 620) may communicate with relay 325 (e.g., and/or tracking device 335). In the tournament play mode or setting, operation assembly 315 may be operated each time a user pushes actuator 550 (e.g., an "8, 9 and 10 ball forgiveness" button). For example as users play on machine 305 in the tournament play mode or setting, users may operate operation assembly 315 to drop pool balls and continue play by pushing actuator 550. Each time a user actuates actuator 550, the exemplary disclosed display assembly (e.g., display assembly 320, display assembly 520, or display assembly 620) may communicate with tracking system 310 (e.g., via relay 325) to operate operation assembly 315 (e.g., via relay 325, controller 355, and/or tracking device 335 as described above). For example, the exemplary disclosed display assembly (e.g., display assembly 320, display assembly 520, or display assembly 620) may emit an electrical pulse (e.g., based on an actuation of actuator 550), which may be similar to the exemplary electrical pulses described above (e.g., an electrical pulse of between 5 volts and 24 volts such as a 12 volt DC electrical pulse), to tracking device 335 via relay 325. Tracking device 335 and/or the tracking device of the exemplary disclosed display assembly (e.g., display assembly 320, display assembly 520, or display assembly 620) may track or count each time actuator 550 is actuated to operate operation assembly 315 (e.g., to drop balls). Similar to as described for example herein, a predetermined fee could be agreed on to charge a user running a tournament (e.g., so that an owner of machine 305 may generate and track revenue from tournament play, including greens fee tournaments or any other suitable type of tournament). Accordingly, the tournament play mode or setting may allow for users or event organizers to be charged per game (e.g., each time actuator 550 is pressed or actuated) without money being paid via coins, currency, or via app payment. That is for example, the tournament play mode or setting may allow for users or event organizers to be charged each time actuator 550 is pressed to cause operation assembly 315 to operate (e.g., drop pool balls).

In at least some exemplary embodiments, the exemplary disclosed display assembly (e.g., display assembly 320, display assembly 520, or display assembly 620) may allow for charging of device such as smart phones for free when a game is being played (e.g., via electrical component 645). Also for example, the phone charging service may be purchased by users via an app of system 300 (e.g., a timer circuit may turn off electrical component 645 once paid time has expired). Also for example, a company may provide power charging for free for example in exchange for advertising.

FIGS. 11 and 12 graphically illustrate features of an algorithm that may be used to control available features of system 300 as a function of payment made to system 300. For example as illustrated in FIGS. 11 and 12, controller 355 may control system 300 to provide predetermined play times or periods to users of machine 305 based on payment provide by users to system 300.

Figure 13:
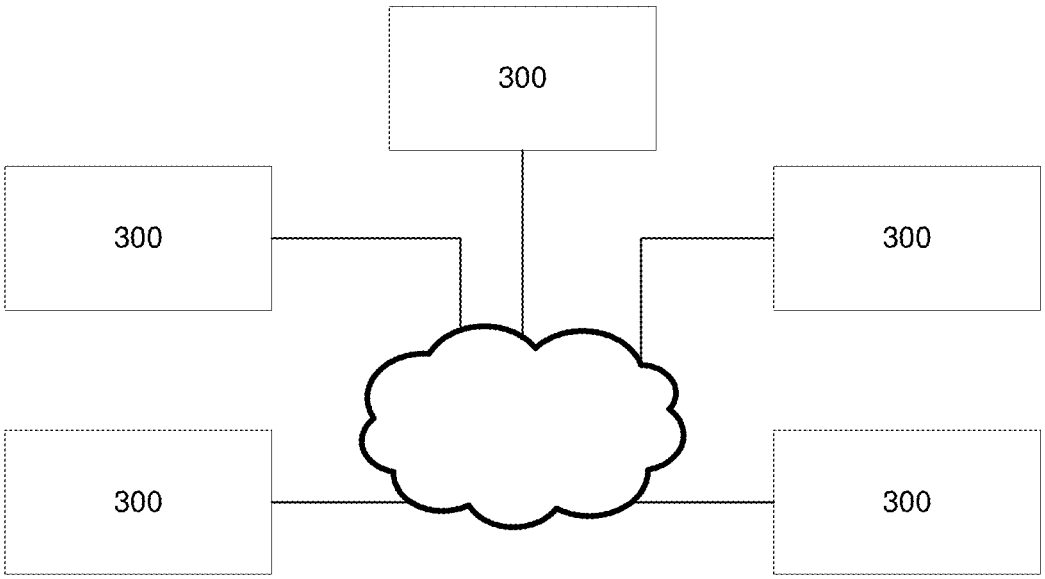
FIG. 13 is a schematic illustration of an exemplary embodiment of the present disclosure.

FIG. 13 schematically illustrates a system including a plurality of systems 300. Each system 300 may communicate with some or all of the other systems 300 via network communication, direct wire or wireless communication, or any other suitable communication technique as described for example herein. Data collected by all systems 300 (e.g., by an operation of respective tracking devices 335 and/or controllers 355) may be aggregated together and processed. For example, tournament play involving any desired number of systems 300 disposed in any desired locations may be facilitated by the exemplary disclosed system, method, and apparatus. For example, the exemplary disclosed system and method may determine a total number of times the exemplary disclosed operation assemblies 315 of a plurality of exemplary disclosed game machines 305 were actuated.

Figure 14A:
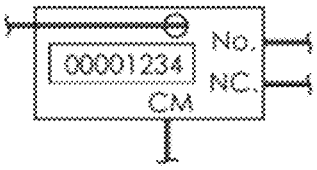
FIG. 14A is a schematic illustration of an exemplary embodiment of the present disclosure.
Figure 14B:
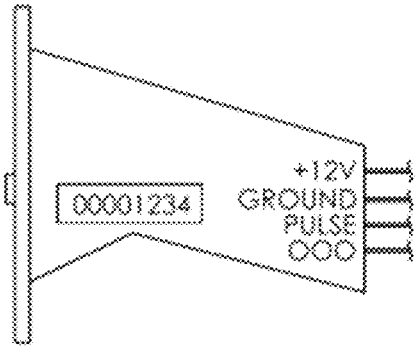
FIG. 14B is a schematic illustration of an exemplary embodiment of the present disclosure.
Figure 14C:
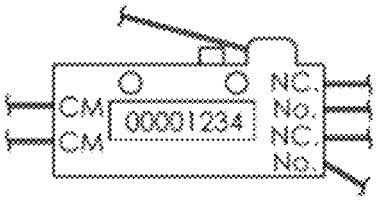
FIG. 14C is a schematic illustration of an exemplary embodiment of the present disclosure.

FIGS. 14A, 14B, and 14C schematically illustrate exemplary embodiments of exemplary disclosed coin switches and relays for example as described above. For example, FIG. 14A illustrates an exemplary switch (e.g., coin switch) having an un-resettable coin meter. FIG. 14B illustrates an exemplary switch (e.g., coin acceptor) having an un-resettable coin meter. FIG. 14C illustrates an exemplary switch (e.g., DPDT switch) having an un-resettable coin meter. Coin switches and/or coin meters that may be included in operation assembly 315 (e.g., to initiate a start of a pool game by dropping pool balls) may include electro-mechanical coin meters in an exemplary disclosed switch of operation assembly :315. For example, by having a coin switch (e.g., as illustrated in FIGS. 14A-14C, such as a DPDT switch) having built-in meters that may work mechanically or electronically, a double-check may be provided on a primary or main meter that may be installed in machine 305 (e.g., in operation assembly 315). in at least some exemplary embodiments, a coin meter that may be installed in machine 305 may be disconnected (e.g., by a hired collector of a vending company, for example, unsuitably disconnected). By having a switch (e.g., coin meter such as illustrated in FIGS. 14A to 14C) built into a switch of operation assembly 315, there may be substantially no way to cheat on how many coins or vends may occur on machine 305.

Figure 15:
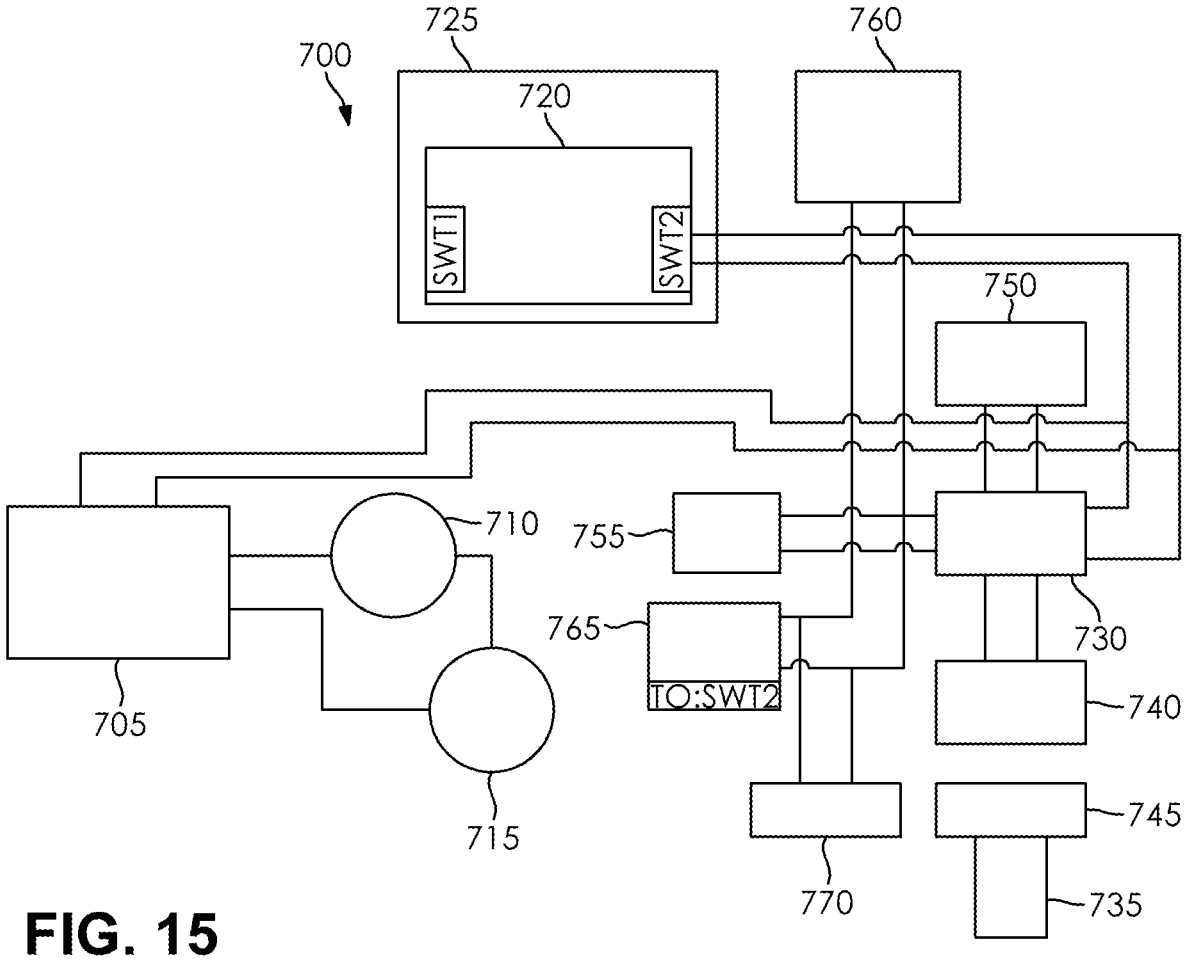
FIG. 15 is a schematic illustration of an exemplary embodiment of the present disclosure.

FIG. 15 illustrates another exemplary embodiment of the exemplary disclosed system, method, and apparatus. System 700 may be used in generally similar applications as system 300. System 700 may include an electromechanical coin meter and/or a contactless payment system for example as described herein. In at least some exemplary embodiments, system 700 may include a contactless pool table coin chute with electromechanical coin meter and pay range payment for some or substantially all commercially-available game machines such as pool tables.

System 700 may include a meter assembly 705 that may include components similar to display assembly 320, display assembly 520, and/or display assembly 620. In at least some exemplary embodiments, meter assembly 705 may be a free play and league meter similar to the exemplary disclosed components described herein. Meter assembly 705 may include (e.g., be electrically connected to) an actuator 710 that may be similar to actuator 550 and also a key switch 715 that may be similar to key switch 642.

Meter assembly 705 may be electrically connected to a circuit board 720 of a machine 725 that may be similar to machine 305. For example, system 700 may operate similarly relative to machine 725 as the exemplary operation described above of system 300 relative to machine 305. In at least some exemplary embodiments, circuit board 720 may be a smart electronic circuit board such as, for example, a smart pool table electronic circuit board (e.g., a Diamond smart pool table electronic circuit board). Circuit board 720 may include components similar to components of controller 355. Meter assembly 705 may also be electrically connected to a relay 730. Relay 730 may include components that may be similar to relay 325. In at least some exemplary embodiments, relay 730 may be a DPDT relay such as a 12V DPDT relay. Relay 730 may be for example a coin chute relay.

Figure 16:
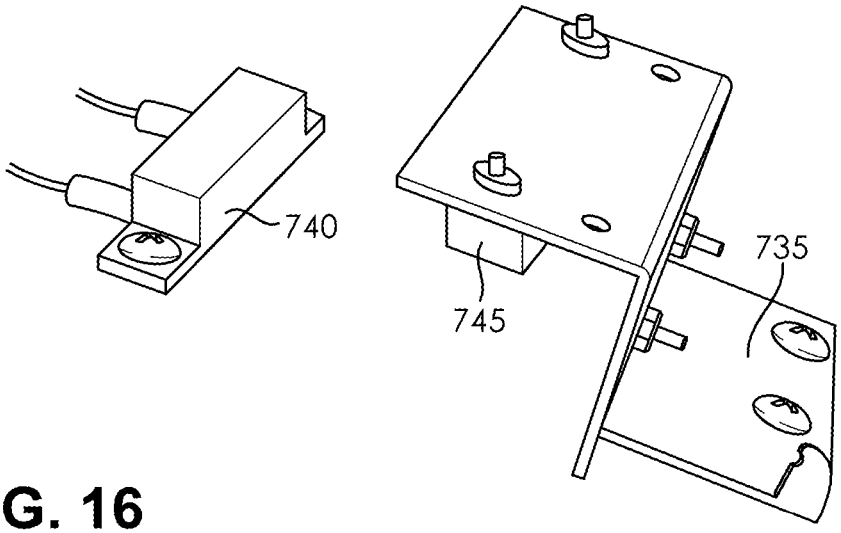
FIG. 16 is a perspective illustration of an exemplary embodiment of the present disclosure.

For example as illustrated in FIGS. 15 and 16, relay 730 may be selectively connected with a payment mechanism 735 via a switch 740 and a magnet 745. Payment mechanism 735 may include any suitable mechanical components for forming a movable assembly such as structural members (e.g., angles and/or channels), fasteners (e.g., bolts and other suitable fasteners), springs, and/or any other suitable components. In at least some exemplary embodiments, payment mechanism 735 may be a coin chute mechanism or any other suitable mechanism configured to receive coin and/or currency payment. Payment mechanism 735 may be a coin push chute that may be configured to push a switch (e.g., a large DPDT micro switch) to actuate machine 725 (e.g., drop pool balls), though in the present embodiment payment mechanism 735 may move magnet 745 to actuate switch 740 as described below. Payment mechanism 735 may allow for cash (e.g., coin) payment for use of machine 725.

Switch 740 may be any suitable electrical switch for operating with magnet 745. For example, switch 740 may be a reed switch (e.g., a switch including ferromagnetic members that may be moved together when close to magnet 745). Switch 740 may be a normally open reed switch. As illustrated in FIG. 16, magnet 745 may be attached to a movable component (e.g., a movable assembly of structural components forming a coin chute that may be pushed inward toward a pool table by a user and urged back outward by attachment to a spring) of payment mechanism 735. As magnet 745 is moved toward and near (e.g., over or above) switch 740, switch 740 may be operated. For example, magnet 745 being disposed at or close to switch 740 may cause ferromagnetic members of switch 740 that are disposed apart in a normally open position to move together to cause switch 740 to move to a closed position. Magnet 745 being moved near switch 740 may cause switch 740 to close a circuit with relay 730. Switch 740 may close a 12 vdc relay circuit to activate circuit board connector SWT2 of circuit board 720 to activate (e.g., to pull) a solenoid of machine 725 (e.g., to actuate machine 725, for example to drop pool balls for example as described herein). For example, machine 725 may include a solenoid (e.g., for controlling a ball drop of a machine 725 when it may be a pool table) that is activated based on an operation of switch 740. The solenoid may be similar to the exemplary disclosed solenoid described below regarding FIGS. 18, 19, and 20A through 20C.

System 700 may also include a tracking device 750 that may be similar to tracking device 335. In at least some exemplary embodiments, tracking device 750 may be a 12 VDC coin meter. Tracking device 750 may be electrically connected to relay 730. A converter 755 may be electrically connected to relay 730. Converter 755 may be a 12 VDC converter. For example, converter 755 may be a wall outlet converter.

System 700 may include a power storage 760 that may be similar to power storage 340. In at least some exemplary embodiments, power storage 760 may be a 12 VDC battery. Power storage 760 may be electrically connected to a payment device 765 that may be similar to payment device 330. In at least some exemplary embodiments, payment device 765 may be a Pay Range Blue Key payment device. Payment device 765 may be electrically connected to connector SWT2 of circuit board 720 as illustrated in FIG. 15. Payment device 765 may also be electrically connected to a relay 770 that may be similar to relay 325. In at least some exemplary embodiments, relay 770 may be a 12 VDC DPDT solid state relay.

In at least some exemplary embodiments, system 700 may be used with any suitable (e.g., substantially all) commercial pool tables. For example, system 700 may operate with Diamond pool tables based on using a DPDT 12 vdc relay. Magnet 745 may be attached to an end portion of payment mechanism 735. Magnet 745 may trip a normally open switch 740 to provide for contactless operation of switch 740 for example as described above.

In at least some exemplary embodiments, switch 740 may selectively close relay 730 based on the exemplary movement of magnet 745 described above to activate connector SW of circuit board 720 to activate (e.g., to pull) a solenoid of machine 725 (e.g., to actuate machine 725, for example to drop pool balls for example as described herein). At the same time, an electrical pulse (e.g., a 12 vdc pulse) may be transferred to tracking device 750 for counting for example as described herein. For example, a number (e.g., one or more numbers) may be put up on tracking device 750 to track cash plays. Payment device 765 may be electrically connected to (e.g., may be in line with) relay 770 to electrically connect to circuit board 720 to complete a vending transaction of machine 725. For example, relay 770 may be electrically connected to connector SWT2 on circuit board 720 (e.g., may provide for one vending transaction or "vend" at a time).

Figure 17:
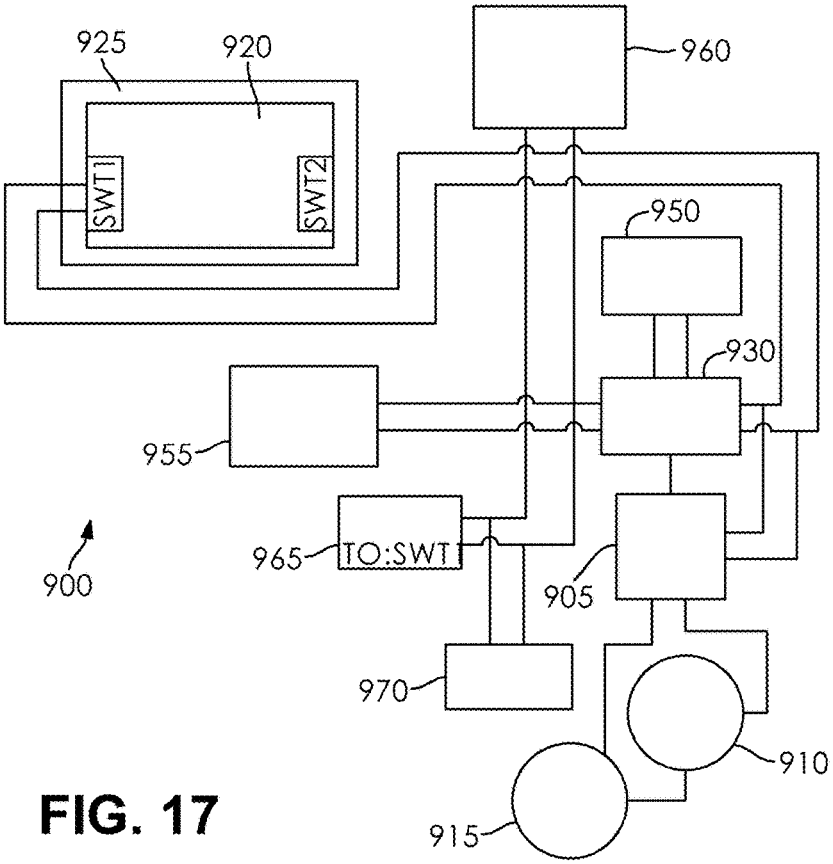
FIG. 17 is a schematic illustration of an exemplary embodiment of the present disclosure.

FIG. 17 illustrates another exemplary embodiment of exemplary disclosed system, method, and apparatus. System 900 may include a meter assembly 905 that may be similar to meter assembly 705, an actuator 910 that may be similar to actuator 710, and a key switch 915 that may be similar to key switch 715. System 900 may also include a circuit board 920 that may be similar to circuit board 720, and a machine 925 that may be similar to machine 725. System 900 may further include a relay 930 that may be similar to relay 730, and a tracking device 950 that may be similar to tracking device 750. System 900 may also include a converter 955 that may be similar to converter 755, a power storage 960 that may be similar to power storage 760, a payment device 965 that may be similar to payment device 765, and a relay 970 that may be similar to relay 770.

As illustrated in FIG. 17, system 900 may provide a timing circuit for a use of machine 925. System 900 may provide any desired time period of the timing circuit such as, for example, between about 5 minutes and about an hour (e.g., about 30 minutes), several hours, or any other desired time period. Circuit board 920 may include a connector SWT1 (e.g., and a connector SWT2). A user may activate the system based on using a mobile device (e.g., mobile application) or other suitable device to activate payment device 965 for example as described herein. For example, the user may use a mobile device to provide payment to payment device 965 to activate the timing circuit of system 900 (e.g., as illustrated in FIG. 17) without involving or using mechanical payment (e.g., coin or cash payment). For example, payment device 965, the exemplary disclosed relays, and circuit board 920 (e.g., via connector SWT1) may be electrically connected to activate machine 925 for use (e.g., to activate one or more solenoids of machine 925 to drop pool balls). Also for example (e.g., based on electrical connection to SWT1 and SWT2), key switch 915, actuator 910, and meter assembly 905 may be electrically connected to circuit board 920 to selectively actuate (e.g., drop pool balls) of machine 925. The exemplary disclosed meter may thereby be electrically connected (e.g., be in line) to track actuations of machine 925 (e.g., the one or more solenoids dropping pool balls and/or any other desired actuation for any desired use) to track some or substantially all ball drops (e.g., from league play and/or free play options)

Figure 18:
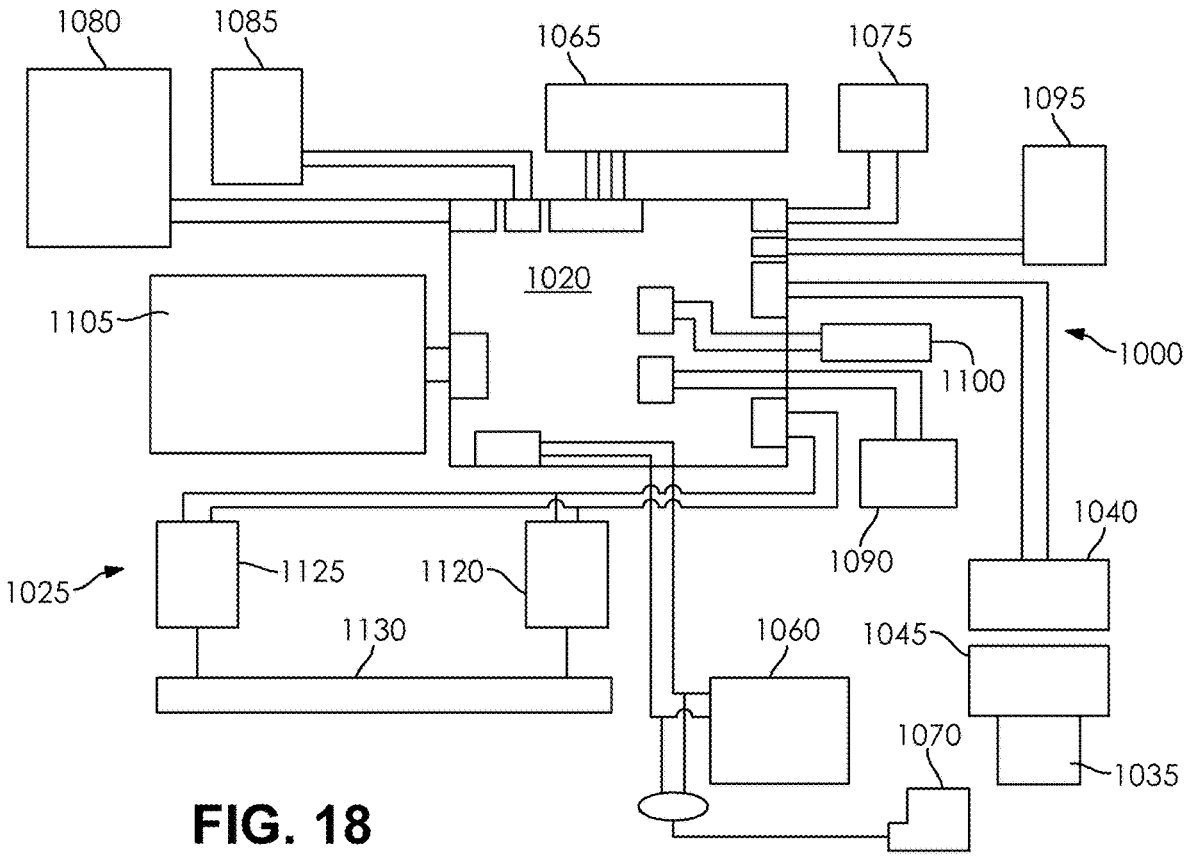
FIG. 18 is a schematic illustration of an exemplary embodiment of the present disclosure.
Figure 19:
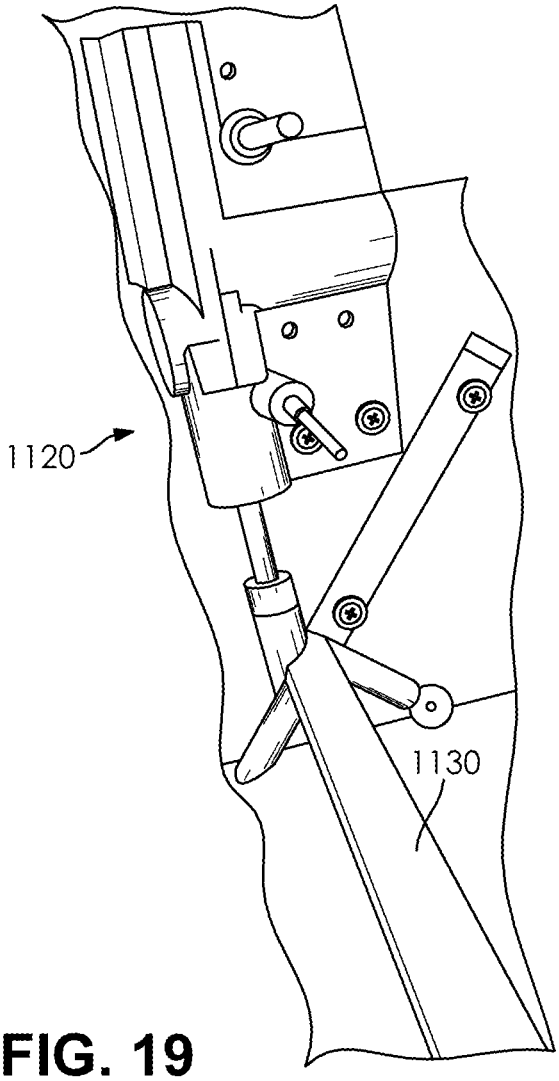
FIG. 19 is a perspective illustration of an exemplary embodiment of the present disclosure.

FIG. 18 illustrates another exemplary embodiment of exemplary disclosed system, method, and apparatus. System 1000 may include a circuit board 1020 that may be similar to circuit board 720. Circuit board 1020 may integrated into and may control a machine 1025 that may be similar to machine 725 (e.g., and including components for example as described below). System 1000 may include a payment mechanism 1035 that may be similar to payment mechanism 735, a switch 1040 that may be similar to switch 740, and a magnet 1045 that may be similar to magnet 745. Switch 1040 may be electrically connected to circuit board 1020 and may selectively control an actuation of machine 1025 for example as described herein.

Any suitable components may be electrically connected to and/or controlled by circuit board 1020. A power storage 1060 that may be similar to power storage 340 may be electrically connected to circuit board 1020. Power storage 1060 may be for example a main 12 VDC battery. A payment device 1065 that may be similar to payment device 765 may also be electrically connected to circuit board 1020. A power connector 1070 that may be similar to power connector 345 may electrically connect circuit board 1020 and machine 1025 to a power source such as a wall outlet. Power connector 1070 may be for example a wall outlet 12 VDC converter.

Also as illustrated in FIG. 18, a sensor 1075 that may be a cue ball sensor or other suitable sensor may be electrically connected to circuit board 1020 and/or machine 1025. A vending component 1080 that may provide for any suitable vending transactions (e.g., coin, currency, mobile application, free play and league play for example similar to meter assembly 705, and/or coin chute mechanical devices) may be electrically connected to circuit board 1020 and/or machine 1025. An acceptor component 1085 that may be a DBA (dollar bill acceptor such as a 110 VAC DBA) may be electrically connected to circuit board 1020 and/or machine 1025. An acceptor component 1090 that may be a DBA (dollar bill acceptor such as a 110 VDC DBA) may be electrically connected to circuit board 1020 and/or machine 1025. A power storage 1095 (e.g., D-Cell battery or batteries such as 12 VDC batteries) and a switch 1100 (e.g., a coin switch) may be electrically connected to circuit board 1020 and/or machine 1025.

Also as illustrated in FIG. 18, a display assembly 1105 that may be similar to display assembly 520 may be electrically connected to circuit board 1020 and/or machine 1025. In at least some exemplary embodiments and as illustrated in FIGS. 21A, 21B, 21C, 21D, and 21E, display assembly 1105 may be a universal board (e.g., a challenger unit) including an actuator 1110 (e.g., for a pool ball drop as illustrated in FIGS. 20A through 20C) that may be similar to actuator 550 and that may be a league and free play switch and counter, player order tracking, 8-ball forgiveness when machine 1025 is a pool table, and/or one or more indicators 1115 that may be low LED battery indicators.

Also as illustrated in FIGS. 18, 19, and 20A through 20C, an electrical actuator 1120 may be electrically connected to circuit board 1020 and/or machine 1025 and may be electrically controlled by circuit board 1020 (e.g., based on an operation of any suitable exemplary disclosed components). Electrical actuator 1120 may be any suitable actuatable electrical component such as, for example, a linear solenoid, a rotary solenoid, or any other suitable electrical and/or magnetic component for actuating an assembly. For example, electrical actuator 1120 may be a 12 VDC push-pull solenoid. Electrical actuator 1120 may operate in conjunction with one or more additional electrical components 1125 such as, for example, additional solenoids or other suitable components (e.g., 12 VDC electrical components) for facilitating an operation of the exemplary components described below.

Figure 20A:
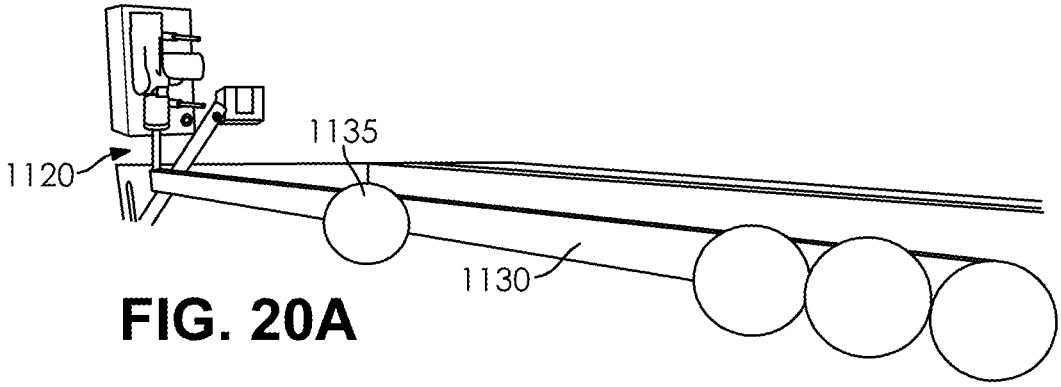
FIG. 20A is a perspective illustration of an exemplary embodiment of the present disclosure.
Figure 20B:
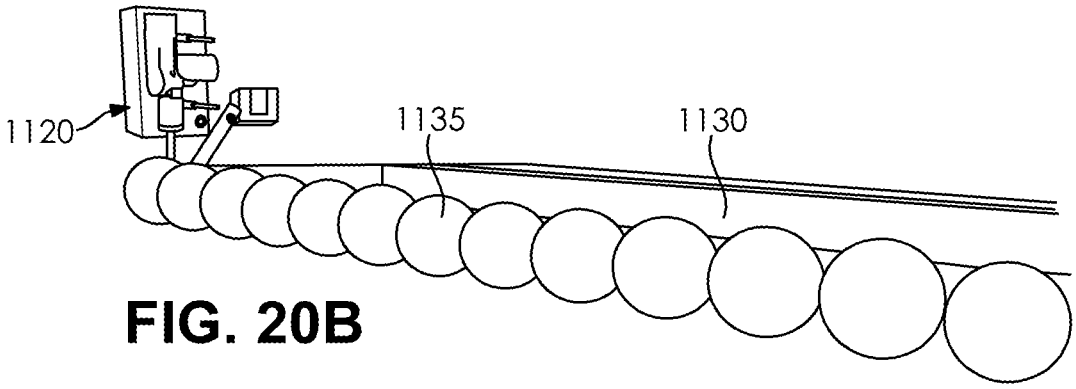
FIG. 20B is a perspective illustration of an exemplary embodiment of the present disclosure.
Figure 20C:
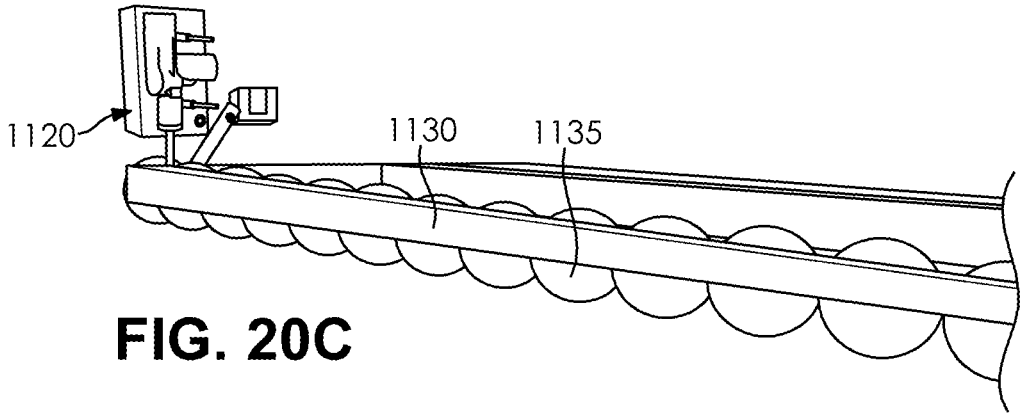
FIG. 20C is a perspective illustration of an exemplary embodiment of the present disclosure.
Figure 21A:
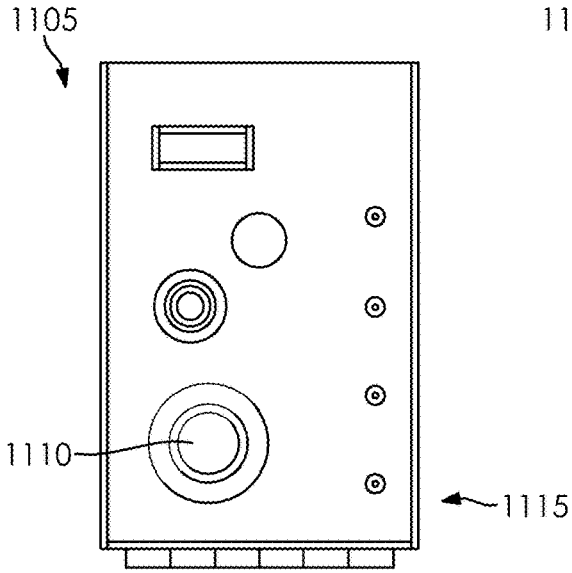
FIG. 21A is a front illustration of an exemplary embodiment of the present disclosure.
Figure 21B:
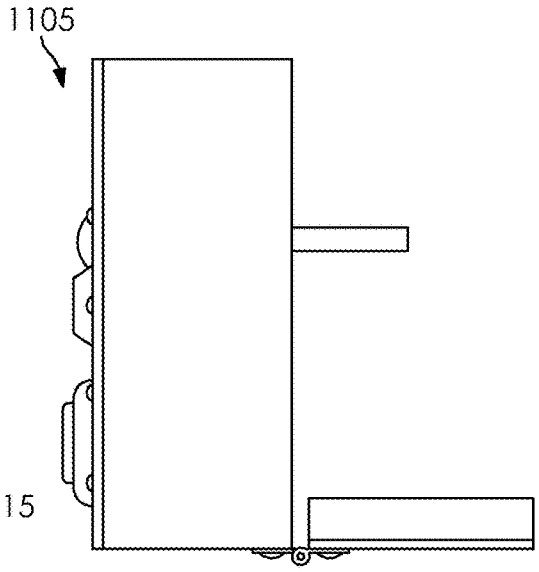
FIG. 21B is a side illustration of an exemplary embodiment of the present disclosure.
Figure 21C:
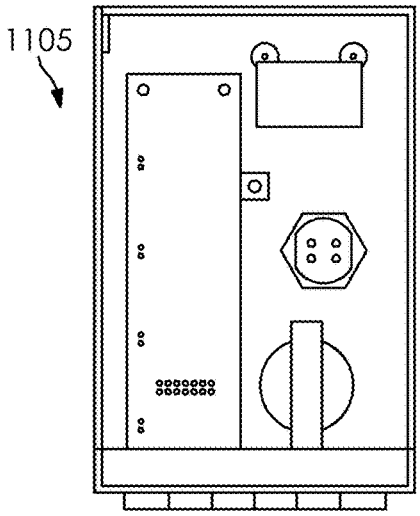
FIG. 21C is a rear illustration of an exemplary embodiment of the present disclosure.
Figure 21D:
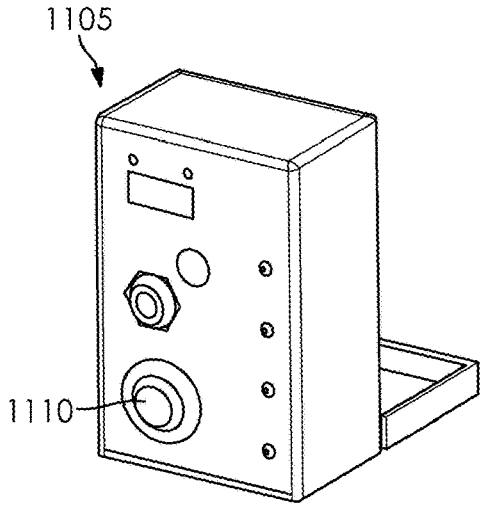
FIG. 21D is a perspective illustration of an exemplary embodiment of the present disclosure.
Figure 21E:
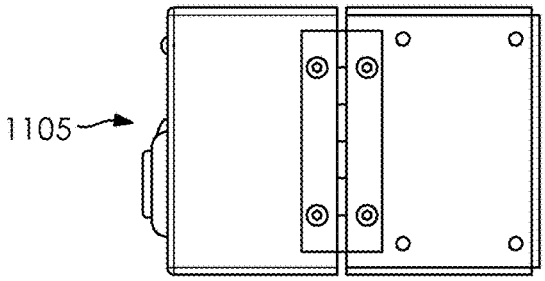
FIG. 21E is a bottom illustration of an exemplary embodiment of the present disclosure.
Figure 23A:
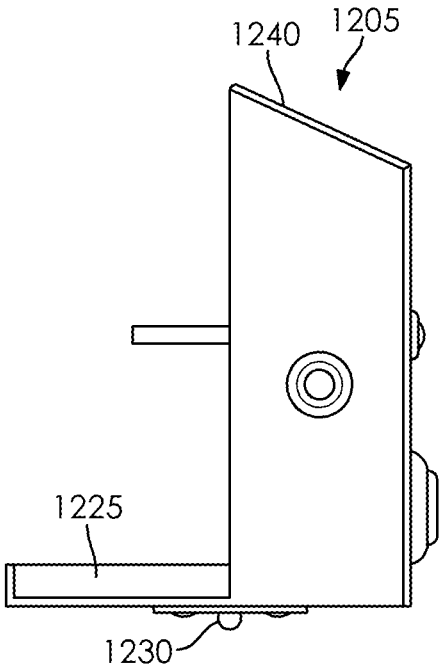
FIG. 23A is a side illustration of an exemplary embodiment of the present disclosure.
Figure 23B:
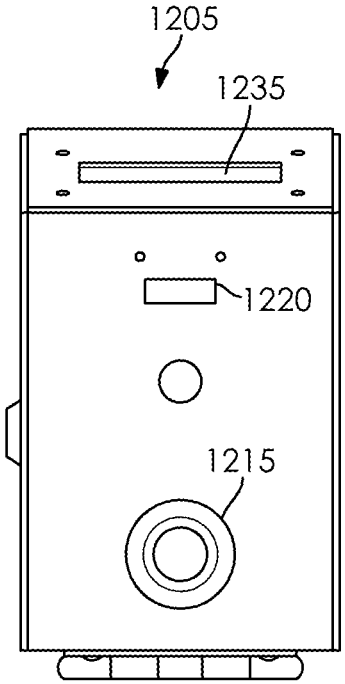
FIG. 23B is a front illustration of an exemplary embodiment of the present disclosure.
Figure 23C:
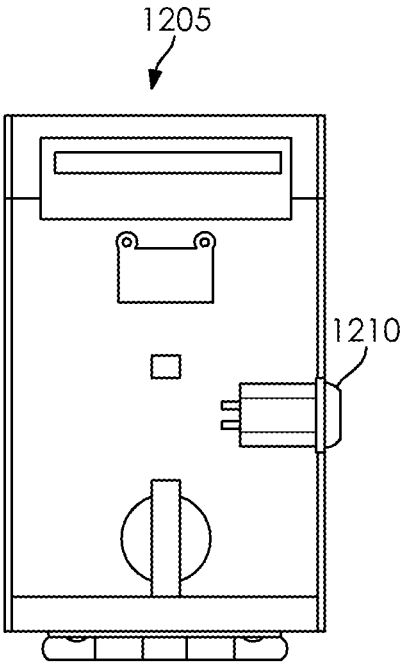
FIG. 23C is a rear illustration of an exemplary embodiment of the present disclosure.
Figure 23D:
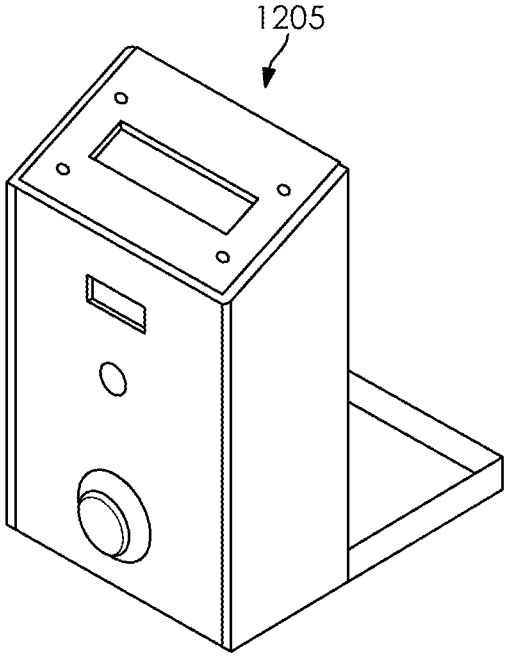
FIG. 23D is a perspective illustration of an exemplary embodiment of the present disclosure.

As illustrated in FIGS. 18, 19, and 20A through 20C, electrical actuator 1120 (e.g., and electrical component 1125) may operate to actuate (e.g., raise and lower) a structural member 1130. Structural member 1130 may be actuated by electrical actuator 1120 and electrical component 1125 to actuate a component of machine 1025 such as structural member 1130. Structural member 1130 may be for example a trap bar that selectively blocks and allows a drop of pool balls (e.g., or any other actuation for any suitable type of machine or activity for example as described herein). Structural member 1130 may hold or retain objects 1135 such as pool balls as shown in FIG. 20A. As illustrated in FIG. 20B, electrical actuator 1120 (e.g., and electrical component 1125) may be activated based on control by circuit board 1020 to move (e.g., actuate) structural member 1130 upward as illustrated in FIG. 20B. As illustrated in FIG. 20C, objects 1135 (e.g., pool balls) may be released (e.g., dropped) for use by users in activities (e.g., pool game) using machine 1025. Structural member 1130 may be an elongated member (e.g., a long metal bar) that may selectively drop pool balls and then either close until payment is made again, or remain open for any desired period of timed play. In at least some exemplary embodiments, the exemplary circuit of system 1000 illustrated in FIG. 18 may provide for a time delay (e.g., between about 2 seconds and about 20 seconds, about a 5 second delay, or any other suitable time delay) to move (e.g., pull upward or pull open) structural member 1130 to provide for some or all balls of system 1000 (e.g., that may be a pool table) being dropped when vending occurs.

In at least some exemplary embodiments, system 1000 may include structural member 1130 (e.g., a 12 VDC solenoid-driven trap bar) used with app (e.g., mobile application) or cash payment, 110 AC DBA, 12 VDC DBA acceptors, and/or one or more coin switches. For example, payment mechanism 1035, switch 1040, and magnet 1045 (e.g., forming a contactless coin chute) may activate display assembly 1105 (e.g., a universal board) to have electrical actuator 1120 and electrical component 1125 (e.g., two 12 vdc solenoids) to pull up structural member 1130 such as a trap bar. System 1000 may operate using any suitable features for example as described herein (e.g., League Play, Free Play, Cash Play, player order tracking, 8-Ball forgiveness, App Payments, and/or tracking of some or substantially all league plays and cash plays).

In at least some exemplary embodiments, system 1000 may include a relay (e.g., a 12 VDC solid state relay) that may be similar to relay 770 and that may receive a pulse (e.g., an electrical pulse) from display assembly 1105. Power may then be provided (e.g., 12 vdc provided directly from power storage 1060 such as a battery and/or power connector 1070 such as a converter) to drive electrical actuator 1120 and electrical component 1125, which may be two solenoids.

In at least some exemplary embodiments, structural member 1130 of system 1000 may be added to substantially any coin-operated pool table and/or billiard parlor table to convert such table into an App-operated pool table (e.g., pool table operated by mobile application). When the exemplary system includes both an exemplary disclosed payment mechanism such as a coin chute and an exemplary disclosed payment system such as an app-payment system (e.g., for example as described herein), system 1000 may track game plays started with coins and/or mobile app payment. For example, switch 1040 may provide an electrical pulse to circuit board 1020 and/or display assembly 1105 to activate electrical actuator 1120 and electrical component 1125 to actuate structural member 1130 (e.g., to drop the pool balls). Display assembly 1105 (e.g., a challenger box) for example as illustrated in FIGS. 21A, 21B, 21C, 21D, and 21E may be added (e.g., attached) to such machines 1025 (e.g., pool tables). In at least some exemplary embodiments, such machines 1025 (e.g., operating with components of system 1000 as illustrated in FIG. 18) may utilize the exemplary disclosed 8-ball forgiveness feature, exemplary disclosed battery level displays (e.g., via LEDs mounted in display assembly 1105), and/or the exemplary disclosed league/free play key switch (e.g., similar to key switch 715) with counter to drop pool balls.

FIGS. 22A, 22B, and 22C graphically illustrate features of an algorithm that may be used to control available features of system 700, system 900, and/or system 1000, as a function of payment made to the exemplary disclosed system. For example as illustrated in FIGS. 22A, 22B, and 22C, the exemplary disclosed controller may control system 700, system 900, and/or system 1000 (e.g., and/or any other suitable exemplary disclosed system for example as described herein) to provide predetermined play times or periods to users of the exemplary disclosed machines based on payment provide by users to the exemplary disclosed systems.

FIGS. 23A, 23B, 23C, and 23D illustrate another exemplary embodiment of the exemplary disclosed display assembly. Display assembly 1205 may be generally similar to display assembly 1105 and may include similar components as the components of display assembly 1105 described above. Display assembly 1205 may include a key switch 1210 that may be similar to key switch 642. Display assembly 1205 may also include an actuator 1215 (e.g., a button to drop balls) that may be similar to actuator 550. Display assembly 1205 may also include a game counter 1220 that may display a number of games that have been played (e.g., for example a number of games that have been played during a predetermined time period such as free play or league play). Display assembly 1205 may be rotatably attached to a support member 1225, which may be attached to an exemplary disclosed machine, via a rotatable connector 1230 such as a hinge. Support member 1225 and rotatable connector 1230 may form a hinged mounting bracket that may allow for electrical connectors (e.g., cables or wires) of display assembly 1205 to be attached (e.g., run) to a bottom of the exemplary disclosed machine. Display assembly 1205 may thereby be selectively rotated about rotatable connector 1230 when desired (e.g., to make access to portions of display assembly 1205 and/or the exemplary disclosed machine easier). Display assembly 1205 may also have a display 1235 that may be a liquid crystal display (LCD), a light-emitting diode (LED), or any other suitable display for displaying data of the exemplary disclosed system to a user. An upper portion 1240 may include a surface that may be slanted or tilted (e.g., slanted or tilted downward) so that objects (e.g., a beverage container) may not be placed on the top surface of display assembly 1205.

In at least some exemplary embodiments, the exemplary disclosed apparatus may include an electric relay (e.g., relay 325) configured to be connected to an operation assembly (e.g., operation assembly 315), a tracking device (e.g., tracking device 335) that is connected to the electric relay, and a display assembly (e.g., display assembly 320, display assembly 520, or display assembly 620) that is selectively connected to the electric relay. The display assembly may be configured to transfer an electrical pulse from the display assembly to the tracking device via the electric relay. The operation assembly may perform an operation when the electrical pulse is transferred to the tracking device. The tracking device may count the electrical pulse. The display assembly may include an actuator configured to transfer the electrical pulse when actuated by a user. The display assembly may include a plurality of USB charging ports and a shelf. The display assembly may include a plurality of numbered light-emitting diodes and a display surface that is numbered to correspond to the plurality of numbered light-emitting diodes. The display surface may be a chalkboard or a dry erase board. The display assembly may include a coin-receiving recess disposed adjacent to each of the plurality of numbered light-emitting diodes. The electrical pulse may be a 12 volt DC electrical pulse and the electric relay is a 12 volt double pole double throw relay.

In at least some exemplary embodiments, the exemplary disclosed method may include providing an operation assembly (e.g., operation assembly 315) of a game machine, connecting an electric relay (e.g., relay 325) to the operation assembly, connecting a tracking device (e.g., tracing device 335) to the electric relay, selectively connecting a display assembly (e.g., display assembly 320, display assembly 520, or display assembly 620) to the electric relay, transferring an electrical pulse from the display assembly to the tracking device via the electric relay, actuating the operation assembly when the electrical pulse is received by the tracking device, counting the electrical pulse with the tracking device, and activating an indicator of the display assembly when the electrical pulse is received by the tracking device. The electrical pulse may be transferred from the display assembly to the tracking device via the electric relay when an actuator of the display assembly is actuated. The exemplary disclosed method may further include transferring a second electrical pulse from the display assembly to the tracking device via the electric relay when the actuator of the display assembly is again actuated, actuating the operation assembly when the second electrical pulse is received by the tracking device, and counting the second electrical pulse with the tracking device. The exemplary disclosed method may further include deactivating the indicator of the display assembly and activating a second indicator of the display assembly when the second electrical pulse is received by the tracking device. The exemplary disclosed method may further include deactivating the indicator of the display assembly when a predetermined time period has elapsed. The operation assembly may include a pool table switch that releases at least one playing object that is a plurality of pool balls of the game machine that is a pool table. The operation assembly may include a mechanical push slot of the game machine that is a pool table.

In at least some exemplary embodiments, the exemplary disclosed method may include providing a plurality of game machines (e.g., machine 305) that each have an operation assembly (e.g., operation assembly 315), connecting an electric relay (e.g., relay 325) to the operation assembly at each game machine, connecting a tracking device (e.g., tracking device 335) to the electric relay at each game machine, selectively connecting a display assembly (e.g., display assembly 320, display assembly 520, or display assembly 620) to the electric relay at each game machine, transferring an electrical pulse from the display assembly to the tracking device via the electric relay at each game machine, actuating the operation assembly when the electrical pulse is received by the tracking device at each game machine, counting the electrical pulse with the tracking device at each game machine, and transferring data from the tracking device at each game machine to a network. The exemplary disclosed method may further include determining a total number of times the operation assemblies of the plurality of game machines were actuated based on the transferred data. The exemplary disclosed method may further include activating an indicator of the display assembly when the electrical pulse is received by the tracking device at each game machine. The plurality of game machines may be a plurality of pool tables and the operation assembly of each pool table includes a pool table switch that releases a plurality of pool balls. At each game machine the electrical pulse may be transferred from the display assembly to the tracking device via the electric relay when an actuator of the display assembly is actuated. The exemplary disclosed method may further include, at each game machine, transferring a second electrical pulse from the display assembly to the tracking device via the electric relay when the actuator of the display assembly is again actuated, actuating the operation assembly when the second electrical pulse is received by the tracking device, and counting the second electrical pulse with the tracking device.

In at least some exemplary embodiments, the exemplary disclosed tracking apparatus for a machine having an operation assembly may include an electric relay configured to be connected to the operation assembly, a tracking device that is connected to the electric relay, and a display assembly that is selectively connected to the electric relay. The display assembly may be configured to transfer an electrical pulse from the display assembly to the tracking device via the electric relay. The operation assembly may perform an operation when the electrical pulse is transferred to the tracking device. The operation may include activating one or more actuators to move the operation assembly that is a structural member (e.g., structural member 1130). The machine may be a pool table and the structural member may be a trap bar configured to selectively retain pool balls of the pool table. The display assembly may include an actuator configured to transfer the electrical pulse when actuated by a user. The tracking device may count the electrical pulse. The electrical pulse may be a 12 volt DC electrical pulse and the electric relay may be a 12 volt double pole double throw relay. The tracking apparatus may provide a timing circuit for use of the machine for a time period that begins when the electrical pulse is transferred to the tracking device. The exemplary disclosed tracking apparatus may further include a contactless assembly that is selectively electrically connected to the tracking device, the contactless assembly including a switch (e.g., switch 740 or switch 1040) and a movable assembly including a magnet. The movable assembly may selectively move the magnet to the switch and away from the switch that is a reed switch. The electrical pulse may be transferred when the movable assembly moves the magnet to the switch.

In at least some exemplary embodiments, the exemplary disclosed tracking method may include providing an operation assembly of a game machine, connecting an electric relay to the operation assembly, connecting a tracking device to the electric relay, and selectively connecting a display assembly to the electric relay. The exemplary disclosed tracking method may also include transferring an electrical pulse from the display assembly to the tracking device via the electric relay, actuating the operation assembly that is a structural member (e.g., structural member 1130) by actuating one or more solenoids when the electrical pulse is received by the tracking device, and counting the electrical pulse with the tracking device. The game machine may be a pool table and the structural member is a trap bar configured to selectively retain pool balls of the pool table. Actuating the trap bar may include raising and lowering the trap bar based on actuating the one or more solenoids. The exemplary disclosed tracking method may also include activating an indicator of the display assembly when the electrical pulse is received by the tracking device. The exemplary disclosed tracking method may further include using a timing circuit to begin a time period when the electrical pulse is transferred to the tracking device and then stopping operation of the game machine at the end of time period. The exemplary disclosed tracking method may also include selectively electrically connecting a contactless assembly to the tracking device, the contactless assembly including a switch (e.g., switch 740 or switch 1040) and a movable assembly including a magnet. The exemplary disclosed tracking method may further include selectively electrically connecting the contactless assembly to the tracking device based on moving the magnet to the switch and away from the switch that is a reed switch. The electrical pulse may be transferred when the movable assembly moves the magnet to the switch.

In at least some exemplary embodiments, the exemplary disclosed tracking apparatus for a machine having an operation assembly may include an electric relay configured to be connected to the operation assembly, a tracking device that is connected to the electric relay, a display assembly that is selectively connected to the electric relay, and a contactless assembly that is selectively electrically connected to the tracking device, the contactless assembly including a switch (e.g., switch 740 or switch 1040) and a movable assembly including a magnet. The display assembly may be configured to transfer an electrical pulse from the display assembly to the tracking device via the electric relay. The operation assembly may perform an operation when the electrical pulse is transferred to the tracking device. The operation may include actuating one or more solenoids to move the operation assembly that is a structural member (e.g., structural member 1130). The machine may be a pool table and the structural member may be a trap bar configured to selectively retain pool balls of the pool table. The movable assembly may selectively move the magnet to the switch and away from the switch that is a reed switch. The electrical pulse may be transferred when the movable assembly moves the magnet to the reed switch.

The exemplary disclosed system, method, and apparatus may provide an efficient and effective technique for tracking each initiation of machine game play (e.g., release of pool balls) during any desired period such as a league play period or free play period. The exemplary disclosed system, method, and apparatus may also allow audits of a machine such as a pool table to be viewed online via an operation of the system. The exemplary disclosed system, method, and apparatus may also allow advertisements to be displayed and sold on the exemplary application to sponsor pool league players. The exemplary disclosed system, method, and apparatus may also allow discounted games to be offered to desired users such as pool league players.

Figure 24:
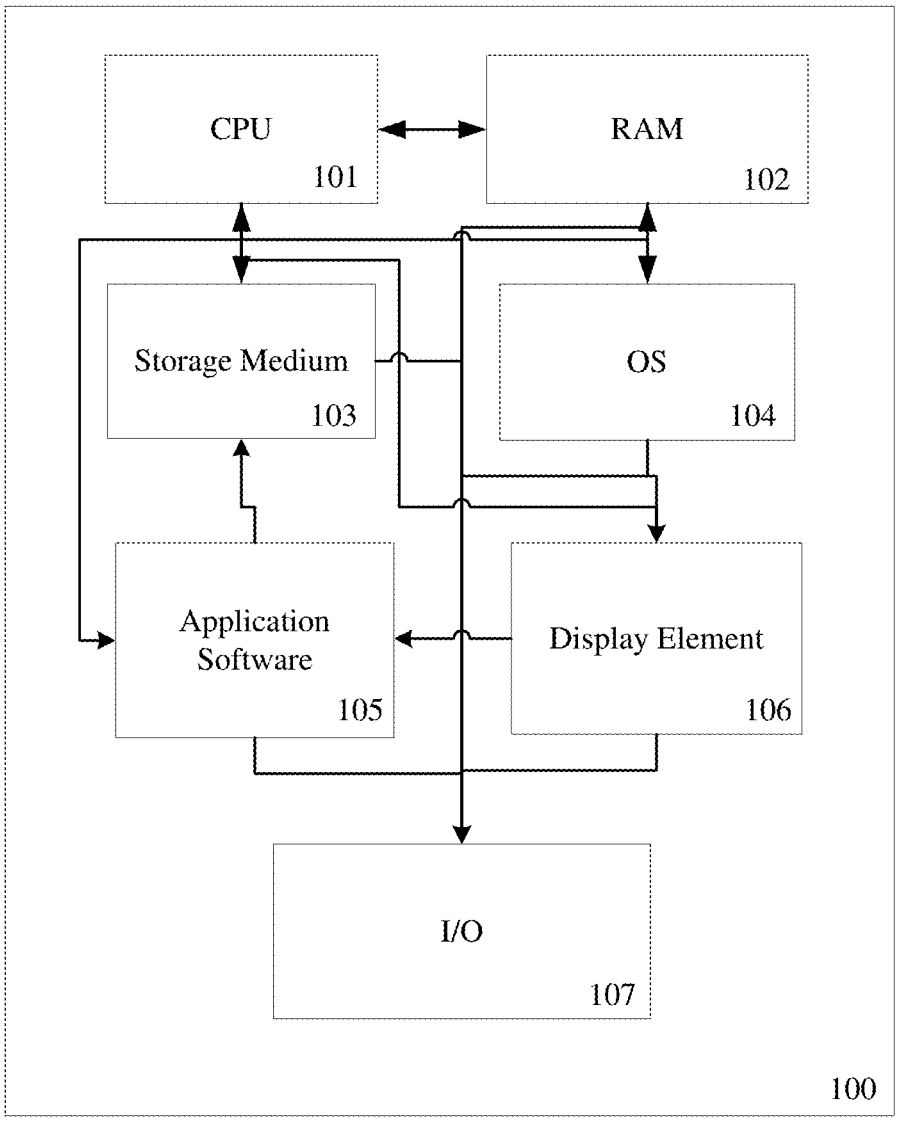
FIG. 24 is a schematic illustration of an exemplary computing device, in accordance with at least some exemplary embodiments of the present disclosure.

An illustrative representation of a computing device appropriate for use with embodiments of the system of the present disclosure is shown in FIG. 24. The computing device 100 can generally be comprised of a Central Processing Unit (CPU, 101), optional further processing units including a graphics processing unit (GPU), a Random Access Memory (RAM, 102), a mother board 103, or alternatively/additionally a storage medium (e.g., hard disk drive, solid state drive, flash memory, cloud storage), an operating system (OS, 104), one or more application software 105, a display element 106, and one or more input/output devices/means 107, including one or more communication interfaces (e.g., RS232, Ethernet, Wifi, Bluetooth, USB). Useful examples include, but are not limited to, personal computers, smart phones, laptops, mobile computing devices, tablet PCs, and servers. Multiple computing devices can be operably linked to form a computer network in a manner as to distribute and share one or more resources, such as clustered computing devices and server banks/farms.

Various examples of such general-purpose multi-unit computer networks suitable for embodiments of the disclosure, their typical configuration and many standardized communication links are well known to one skilled in the art, as explained in more detail and illustrated by FIG. 25, which is discussed herein-below.

According to an exemplary embodiment of the present disclosure, data may be transferred to the system, stored by the system and/or transferred by the system to users of the system across local area networks (LANs) (e.g., office networks, home networks) or wide area networks (WANs) (e.g., the Internet). In accordance with the previous embodiment, the system may be comprised of numerous servers communicatively connected across one or more LANs and/or WANs. One of ordinary skill in the art would appreciate that there are numerous manners in which the system could be configured and embodiments of the present disclosure are contemplated for use with any configuration.

In general, the system and methods provided herein may be employed by a user of a computing device whether connected to a network or not. Similarly, some steps of the methods provided herein may be performed by components and modules of the system whether connected or not. While such components/modules are offline, and the data they generated will then be transmitted to the relevant other parts of the system once the offline component/module comes again online with the rest of the network (or a relevant part thereof). According to an embodiment of the present disclosure, some of the applications of the present disclosure may not be accessible when not connected to a network, however a user or a module/component of the system itself may be able to compose data offline from the remainder of the system that will be consumed by the system or its other components when the user/offline system component or module is later connected to the system network.

Figure 25:
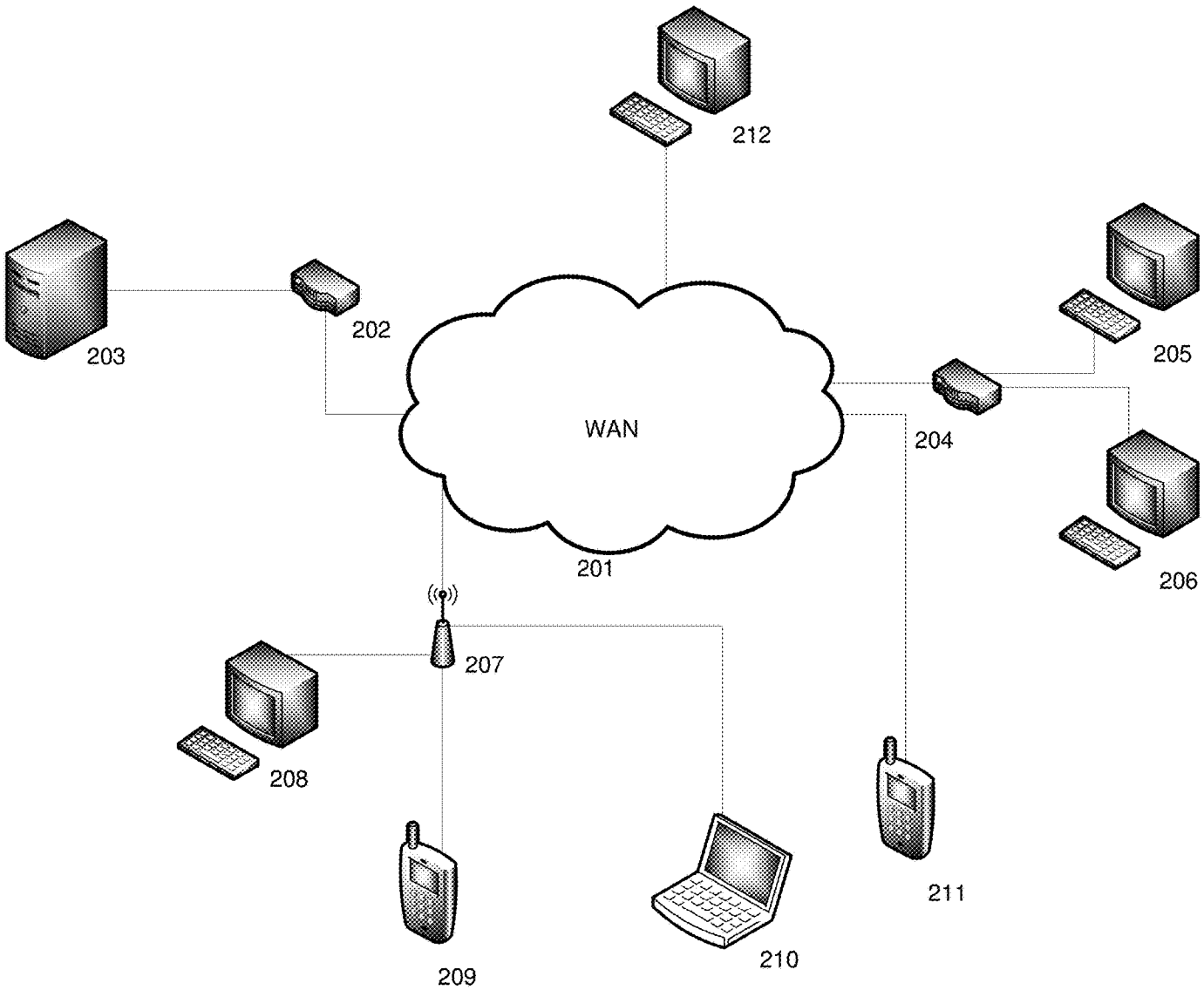
FIG. 25 is a schematic illustration of an exemplary network, in accordance with at least some exemplary embodiments of the present disclosure.

Referring to FIG. 25, a schematic overview of a system in accordance with an embodiment of the present disclosure is shown. The system is comprised of one or more application servers 203 for electronically storing information used by the system. Applications in the server 203 may retrieve and manipulate information in storage devices and exchange information through a WAN 201 (e.g., the Internet). Applications in server 203 may also be used to manipulate information stored remotely and process and analyze data stored remotely across a WAN 201 (e.g., the Internet).

According to an exemplary embodiment, as shown in FIG. 25, exchange of information through the WAN 201 or other network may occur through one or more high speed connections. In some cases, high speed connections may be over-the-air (OTA), passed through networked systems, directly connected to one or more WANs 201 or directed through one or more routers 202. Router(s) 202 are completely optional and other embodiments in accordance with the present disclosure may or may not utilize one or more routers 202. One of ordinary skill in the art would appreciate that there are numerous ways server 203 may connect to WAN 201 for the exchange of information, and embodiments of the present disclosure are contemplated for use with any method for connecting to networks for the purpose of exchanging information. Further, while this application refers to high speed connections, embodiments of the present disclosure may be utilized with connections of any speed.

Components or modules of the system may connect to server 203 via WAN 201 or other network in numerous ways. For instance, a component or module may connect to the system i) through a computing device 212 directly connected to the WAN 201, ii) through a computing device 205, 206 connected to the WAN 201 through a routing device 204, iii) through a computing device 208, 209, 210 connected to a wireless access point 207 or iv) through a computing device 211 via a wireless connection (e.g., CDMA, GMS, 3G, 4G) to the WAN 201. One of ordinary skill in the art will appreciate that there are numerous ways that a component or module may connect to server 203 via WAN 201 or other network, and embodiments of the present disclosure are contemplated for use with any method for connecting to server 203 via WAN 201 or other network. Furthermore, server 203 could be comprised of a personal computing device, such as a smartphone, acting as a host for other computing devices to connect to.

The communications means of the system may be any means for communicating data, including image and video, over one or more networks or to one or more peripheral devices attached to the system, or to a system module or component. Appropriate communications means may include, but are not limited to, wireless connections, wired connections, cellular connections, data port connections, Bluetooth® connections, near field communications (NFC) connections, or any combination thereof. One of ordinary skill in the art will appreciate that there are numerous communications means that may be utilized with embodiments of the present disclosure, and embodiments of the present disclosure are contemplated for use with any communications means.

Figure 26:
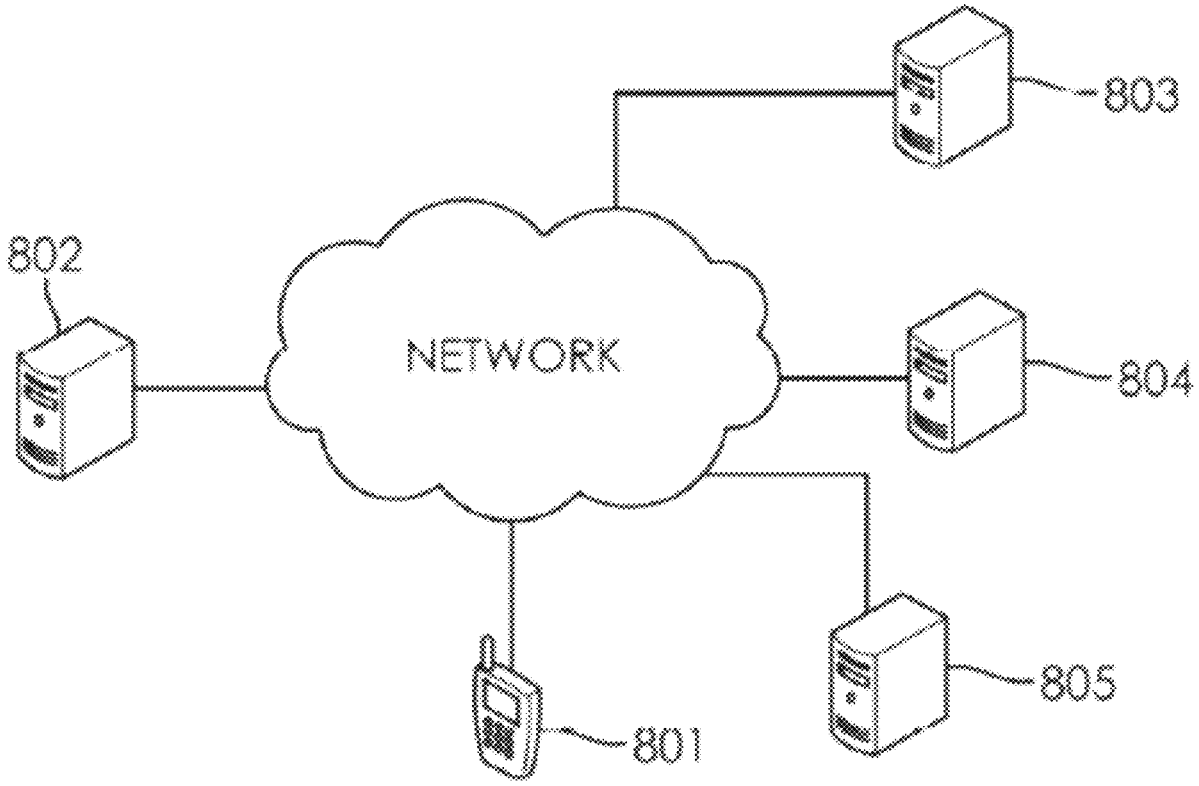
FIG. 26 is a schematic illustration of an exemplary network, in accordance with at least some exemplary embodiments of the present disclosure.

Turning now to FIG. 26, a continued schematic overview of a cloud-based system in accordance with an embodiment of the present invention is shown. In FIG. 26, the cloud-based system is shown as it may interact with users and other third party networks or APIs. For instance, a user of a mobile device 801 may be able to connect to application server 802. Application server 802 may be able to enhance or otherwise provide additional services to the user by requesting and receiving information from one or more of an external content provider API/website or other third party system 803, a constituent data service 804, one or more additional data services 805 or any combination thereof. Additionally, application server 802 may be able to enhance or otherwise provide additional services to an external content provider API/website or other third party system 803, a constituent data service 804, one or more additional data services 805 by providing information to those entities that is stored on a database that is connected to the application server 802. One of ordinary skill in the art would appreciate how accessing one or more third-party systems could augment the ability of the system described herein, and embodiments of the present invention are contemplated for use with any third-party system.

Traditionally, a computer program includes a finite sequence of computational instructions or program instructions. It will be appreciated that a programmable apparatus or computing device can receive such a computer program and, by processing the computational instructions thereof, produce a technical effect.

A programmable apparatus or computing device includes one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computing device can include any and all suitable combinations of at least one general purpose computer, special-purpose computer, programmable data processing apparatus, processor, processor architecture, and so on. It will be understood that a computing device can include a computer-readable storage medium and that this medium may be internal or external, removable and replaceable, or fixed. It will also be understood that a computing device can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the disclosure as claimed herein could include an optical computer, quantum computer, analog computer, or the like.

Regardless of the type of computer program or computing device involved, a computer program can be loaded onto a computing device to produce a particular machine that can perform any and all of the depicted functions. This particular machine (or networked configuration thereof) provides a technique for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Illustrative examples of the computer readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A data store may be comprised of one or more of a database, file storage system, relational data storage system or any other data system or structure configured to store data. The data store may be a relational database, working in conjunction with a relational database management system (RDBMS) for receiving, processing and storing data. A data store may comprise one or more databases for storing information related to the processing of moving information and estimate information as well one or more databases configured for storage and retrieval of moving information and estimate information.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software components or modules, or as components or modules that employ external routines, code, services, and so forth, or any combination of these. All such implementations are within the scope of the present disclosure. In view of the foregoing, it will be appreciated that elements of the block diagrams and flowchart illustrations support combinations of means for performing the specified functions, combinations of steps for performing the specified functions, program instruction technique for performing the specified functions, and so on.

It will be appreciated that computer program instructions may include computer executable code. A variety of languages for expressing computer program instructions are possible, including without limitation C, C++, Java, JavaScript, assembly language, Lisp, HTML, Perl, and so on. Such languages may include assembly languages, hardware description languages, database programming languages, functional programming languages, imperative programming languages, and so on. In some embodiments, computer program instructions can be stored, compiled, or interpreted to run on a computing device, a programmable data processing apparatus, a heterogeneous combination of processors or processor architectures, and so on. Without limitation, embodiments of the system as described herein can take the form of web-based computer software, which includes client/server software, software-as-a-service, peer-to-peer software, or the like.

In some embodiments, a computing device enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computing device can process these threads based on priority or any other order based on instructions provided in the program code.

Unless explicitly stated or otherwise clear from the context, the verbs "process" and "execute" are used interchangeably to indicate execute, process, interpret, compile, assemble, link, load, any and all combinations of the foregoing, or the like. Therefore, embodiments that process computer program instructions, computer-executable code, or the like can suitably act upon the instructions or code in any and all of the ways just described.

The functions and operations presented herein are not inherently related to any particular computing device or other apparatus. Various general-purpose systems may also be used with programs in accordance with the teachings herein, or it may prove convenient to construct more specialized apparatus to perform the required method steps. The required structure for a variety of these systems will be apparent to those of ordinary skill in the art, along with equivalent variations. In addition, embodiments of the disclosure are not described with reference to any particular programming language. It is appreciated that a variety of programming languages may be used to implement the present teachings as described herein, and any references to specific languages are provided for disclosure of enablement and best mode of embodiments of the disclosure. Embodiments of the disclosure are well suited to a wide variety of computer network systems over numerous topologies. Within this field, the configuration and management of large networks include storage devices and computing devices that are communicatively coupled to dissimilar computing and storage devices over a network, such as the Internet, also referred to as "web" or "world wide web".

In at least some exemplary embodiments, the exemplary disclosed system may utilize sophisticated machine learning and/or artificial intelligence techniques to prepare and submit datasets and variables to cloud computing clusters and/or other analytical tools (e.g., predictive analytical tools) which may analyze such data using artificial intelligence neural networks. The exemplary disclosed system may for example include cloud computing clusters performing predictive analysis. For example, the exemplary neural network may include a plurality of input nodes that may be interconnected and/or networked with a plurality of additional and/or other processing nodes to determine a predicted result. Exemplary artificial intelligence processes may include filtering and processing datasets, processing to simplify datasets by statistically eliminating irrelevant, invariant or superfluous variables or creating new variables which are an amalgamation of a set of underlying variables, and/or processing for splitting datasets into train, test and validate datasets using at least a stratified sampling technique. The exemplary disclosed system may utilize prediction algorithms and approach that may include regression models, tree-based approaches, logistic regression, Bayesian methods, deep-learning and neural networks both as a standalone and on an ensemble basis, and final prediction may be based on the model/structure which delivers the highest degree of accuracy and stability as judged by implementation against the test and validate datasets.

Throughout this disclosure and elsewhere, block diagrams and flowchart illustrations depict methods, apparatuses (e.g., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "component", "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

The functions, systems and methods herein described could be utilized and presented in a multitude of languages. Individual systems may be presented in one or more languages and the language may be changed with ease at any point in the process or methods described above. One of ordinary skill in the art would appreciate that there are numerous languages the system could be provided in, and embodiments of the present disclosure are contemplated for use with any language.

While multiple embodiments are disclosed, still other embodiments of the present disclosure will become apparent to those skilled in the art from this detailed description. There may be aspects of this disclosure that may be practiced without the implementation of some features as they are described. It should be understood that some details have not been described in detail in order to not unnecessarily obscure the focus of the disclosure. The disclosure is capable of myriad modifications in various obvious aspects, all without departing from the spirit and scope of the present disclosure. Accordingly, the drawings and descriptions are to be regarded as illustrative rather than restrictive in nature.

What is claimed is:

1. A tracking apparatus for a machine having an operation assembly, comprising:

an electric relay configured to be connected to the operation assembly;

a tracking device that is connected to the electric relay; and a display assembly that is selectively connected to the electric relay;

wherein the display assembly is configured to transfer an electrical pulse from the display assembly to the tracking device via the electric relay;

wherein the operation assembly performs an operation when the electrical pulse is transferred to the tracking device; and wherein the operation includes activating one or more actuators to move the operation assembly that is a structural member.

2. The tracking apparatus of claim 1, wherein the machine is a pool table and the structural member is a trap bar configured to selectively retain pool balls of the pool table.

3. The tracking apparatus of claim 1, wherein the display assembly includes an actuator configured to transfer the electrical pulse when actuated by a user.

4. The tracking apparatus of claim 1, wherein the tracking device counts the electrical pulse.

5. The tracking apparatus of claim 1, wherein the electrical pulse is a 12 volt DC electrical pulse and the electric relay is a 12 volt double pole double throw relay.

6. The tracking apparatus of claim 1, wherein the tracking apparatus provides a timing circuit for use of the machine for a time period that begins when the electrical pulse is transferred to the tracking device.

7. The tracking apparatus of claim 1, further comprising a contactless assembly that is selectively electrically connected to the tracking device, the contactless assembly including a switch and a movable assembly including a magnet.

8. The tracking apparatus of claim 7, wherein the movable assembly selectively moves the magnet to the switch and away from the switch that is a reed switch.

9. The tracking apparatus of claim 7, wherein the electrical pulse is transferred when the movable assembly moves the magnet to the switch.

10. A method, comprising:

providing an operation assembly of a game machine;

connecting an electric relay to the operation assembly;

connecting a tracking device to the electric relay;

selectively connecting a display assembly to the electric relay;

transferring an electrical pulse from the display assembly to the tracking device via the electric relay;

actuating the operation assembly that is a structural member by actuating one or more solenoids when the electrical pulse is received by the tracking device; and counting the electrical pulse with the tracking device.

11. The method of claim 10, wherein the game machine is a pool table and the structural member is a trap bar configured to selectively retain pool balls of the pool table.

12. The method of claim 11, wherein actuating the trap bar includes raising and lowering the trap bar based on actuating the one or more solenoids.

13. The method of claim 11, further comprising activating an indicator of the display assembly when the electrical pulse is received by the tracking device.

14. The method of claim 10, further comprising using a timing circuit to begin a time period when the electrical pulse is transferred to the tracking device and stopping operation of the game machine at the end of time period.

15. The method of claim 10, further comprising selectively electrically connecting a contactless assembly to the tracking device, the contactless assembly including a switch and a movable assembly including a magnet.

16. The method of claim 15, further comprising selectively electrically connecting the contactless assembly to the tracking device based on moving the magnet to the switch and away from the switch that is a reed switch.

17. The method of claim 15, wherein the electrical pulse is transferred when the movable assembly moves the magnet to the switch.

18. A tracking apparatus for a machine having an operation assembly, comprising:

an electric relay configured to be connected to the operation assembly;

a tracking device that is connected to the electric relay;

a display assembly that is selectively connected to the electric relay; and a contactless assembly that is selectively electrically connected to the tracking device, the contactless assembly including a switch and a movable assembly including a magnet;

wherein the display assembly is configured to transfer an electrical pulse from the display assembly to the tracking device via the electric relay;

wherein the operation assembly performs an operation when the electrical pulse is transferred to the tracking device; and wherein the operation includes actuating one or more solenoids to move the operation assembly that is a structural member.

19. The tracking apparatus of claim 18, wherein the machine is a pool table and the structural member is a trap bar configured to selectively retain pool balls of the pool table.

20. The tracking apparatus of claim 18, wherein:

the movable assembly selectively moves the magnet to the switch and away from the switch that is a reed switch; and the electrical pulse is transferred when the movable assembly moves the magnet to the reed switch.

* * * * *